US008505171B2

(12) United States Patent
Colorado

(10) Patent No.: US 8,505,171 B2
(45) Date of Patent: Aug. 13, 2013

(54) QUICK RELEASE APPARATUS FOR AN SCBA FRAME

(75) Inventor: Juancarlos Colorado, Petaluma, CA (US)

(73) Assignee: Fire Innovations LLC, Petaluma, CA (US)

( * ) Notice: Subject to any disclaimer, the term of this patent is extended or adjusted under 35 U.S.C. 154(b) by 167 days.

(21) Appl. No.: 13/193,473

(22) Filed: Jul. 28, 2011

(65) Prior Publication Data

US 2012/0017406 A1 Jan. 26, 2012

Related U.S. Application Data

(63) Continuation-in-part of application No. 12/622,347, filed on Nov. 19, 2009, now Pat. No. 8,312,600, which is a continuation-in-part of application No. 12/105,696, filed on Apr. 18, 2008, now Pat. No. 8,336,171.

(60) Provisional application No. 60/913,230, filed on Apr. 20, 2007, provisional application No. 60/985,948, filed on Nov. 6, 2007.

(51) Int. Cl.
*A44B 11/25* (2006.01)

(52) U.S. Cl.
USPC ..... 24/3.7; 224/675

(58) Field of Classification Search
USPC ..... 24/3.7, 657, 573.09, 578.1, 580.1, 24/578.13, 578.17, 579.09, DIG. 37; 405/108; 224/675, 262, 637
See application file for complete search history.

(56) References Cited

U.S. PATENT DOCUMENTS

| | | | | | |
|---|---|---|---|---|---|
| 3,191,828 | A * | 6/1965 | Senne | 224/604 |
| 3,957,183 | A * | 5/1976 | Gadberry | 224/628 |
| 4,049,164 | A * | 9/1977 | Sullivan et al. | 224/633 |
| 4,327,851 | A * | 5/1982 | Feathers | 224/634 |
| D342,666 | S * | 12/1993 | DePack | D8/373 |
| 5,362,022 | A * | 11/1994 | McLoughlin et al. | 248/313 |
| 5,732,867 | A * | 3/1998 | Perkins et al. | 224/628 |
| 5,823,414 | A * | 10/1998 | Gal et al. | 224/637 |
| 5,987,717 | A | 11/1999 | Peterson et al. | |
| 6,732,834 | B2 | 5/2004 | Colorado | |
| 7,028,873 | B1 * | 4/2006 | Collier et al. | 224/628 |
| 7,080,430 | B2 | 7/2006 | Wemmer | |
| 7,240,404 | B2 | 7/2007 | Flossner | |
| 7,503,535 | B2 * | 3/2009 | Ziaylek | 248/313 |
| 7,526,842 | B2 | 5/2009 | Wemmer | |
| 7,694,862 | B2 | 4/2010 | Bergeron | |
| 2007/0090137 | A1 * | 4/2007 | Kim | 224/153 |
| 2008/0078911 | A1 | 4/2008 | Ziaylek | |
| 2008/0257928 | A1 * | 10/2008 | Lowry et al. | 224/638 |

* cited by examiner

*Primary Examiner* — James Brittain
(74) *Attorney, Agent, or Firm* — Craig M. Stainbrook; Stainbrook & Stainbrook, LLP

(57) ABSTRACT

An apparatus for a rescue worker's waist belt for connecting to and rapidly disconnecting from a self-contained breathing apparatus waist belt. The rescue worker's waist belt includes buckles disposed on its side that complement the buckles disposed on the SCBA waist belt. An SCBA wearer connects the SCBA waist belt directly to the rescue worker's waist belt rather than buckling the waist belt around the wearer's waist. Rapid disconnection is effected with the push of two buttons, thereby allowing the wearer to entirely remove the SCBA from his or her body while leaving the rescue worker's waist belt and any accoutrements attached thereto in place and on his or her person.

5 Claims, 26 Drawing Sheets

FIG. 3C
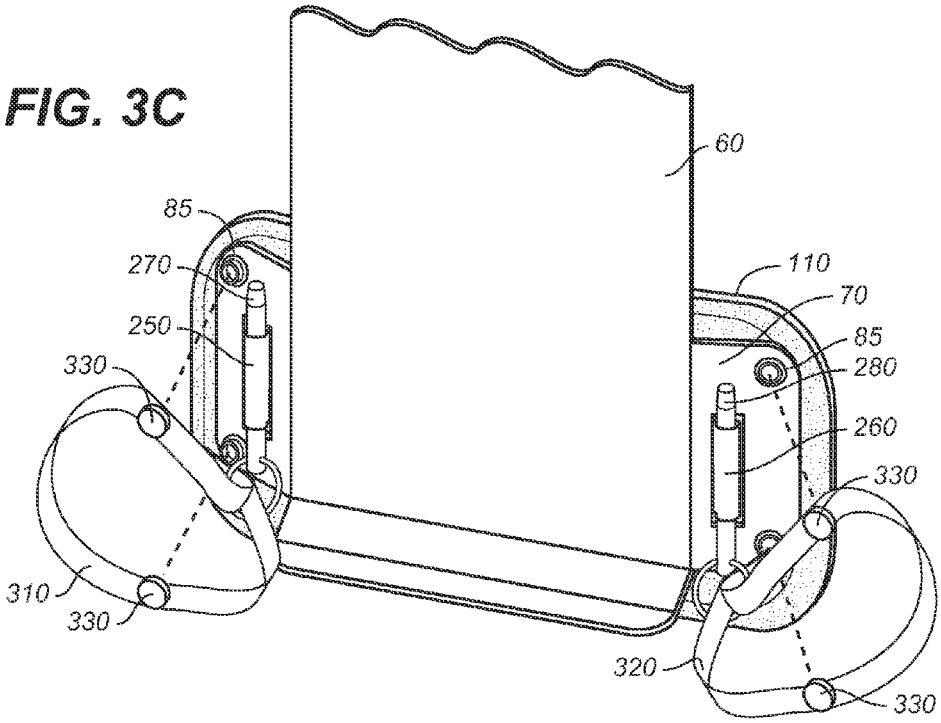
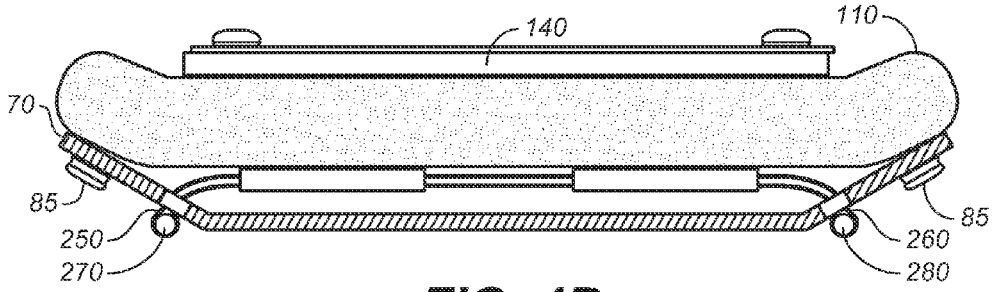
FIG. 4B

QUICK RELEASE APPARATUS FOR AN SCBA FRAME

CROSS REFERENCES TO RELATED APPLICATIONS

The present application is a continuation-in-part of U.S. Utility patent application Ser. No. 12/622,347, filed Nov. 19, 2009 (Nov. 19, 2009), which is a continuation-in-part of U.S. patent application Ser. No. 12/105,696, filed Apr. 18, 2008 (Apr. 18, 2008), which claims the benefit of U.S. Provisional Patent Application Ser. No. 60/913,230, filed Apr. 20, 2007 (Apr. 20, 2007), and U.S. Provisional Patent Application Ser. No. 60/985,948, filed Nov. 6, 2007 (Nov. 6, 2007).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates to firefighter safety equipment, and more particularly to a harness system for a self-contained breathing apparatus (hereinafter referred to as an "SCBA"). Even more particularly, the present invention relates to a quick-release harness system for connecting an SCBA to a firefighter or rescue worker's turnout gear trucker's belt such that the quick-release system may be disconnected and separated from the trucker's belt in a matter of only a few seconds.

2. Discussion of Related Art Including Information Disclosed Under 37 CFR §§1.97, 1.98

People celebrate and wonder at the heroics of firefighters. At the same time, they often romanticize firefighting work, imagining it to be some kind of athletic adventurism that provides an opportunity to show bravery and save people without having to be shot at. In truth, firefighters bear a heavy burden: Their jobs do not include the mere opportunity to rescue people and property from peril; they include the duty to rescue. And in discharging that duty, firefighters regularly inhabit a chaotic and terrifying hell world of flames and superheated air that blisters their skin and sears their eyes, billowing clouds of toxic smoke that instantly burns and damages their lungs, floors that collapse under them to bone breaking effect, roofs and ceilings that collapse over them to bone crushing effect. All the while, firefighters have to maintain their cool, in every respect, and act in the interests of others.

To make such a world navigable and survivable, firefighters don safety and operational equipment that is designed to strike a balance between providing physical maneuverability and providing protection from heat, fire and smoke. Due to the stakes, ongoing efforts are made to incorporate improved technology in firefighter turnout gear and firefighting equipment, and a very high state of maturity has been achieved. Among the many technical improvements are improvements related to the waist belts firefighters wear either inside or outside their turnout coat. Indeed, the present inventor has made contributions to the art in this field, including a combination trucker's belt and extrication harness combination shown in U.S. Pat. No. 6,732,834, comprising a waistband having a number of integral features, including ax holder rings, and a strip of fabric sewn into the waistband so as to form a succession of fabric loops adapted for carrying equipment and tools. The apparatus shown in the '834 patent provided improved means for carrying and deploying an extrication line in the event it was necessary to rapidly egress from a multistory building. A better balance was struck.

However, a perfect balance remains elusive, and one circumstance in which is it particularly difficult to strike the right balance between safety and function is where rescue operations are undertaken in confined and/or congested spaces, such as collapsed or collapsing buildings. Breathing apparatus is necessary in many or most of those situations, and to provide assisted breathing a firefighter or rescue worker must wear some kind of self-contained breathing apparatus (or "SCBA"). The typical apparatus include three principal components, including a tank containing breathable air under high pressure (typically 2200 psi to 4500 psi), a pressure regulator, and an inhalation mouthpiece, mouth mask, or face mask. These elements are operatively coupled and mounted on an SCBA carrying frame, which generally resembles a backpack frame, including shoulder straps, a rigid mid-frame member, a lower lumbar support, and a hip/waist belt (refer to FIG. 1).

While the SCBA provides breathable air for hostile environments, it also greatly limits movement, and in some circumstances it can impede passage into or through a confined space. For instance, when a roof or ceiling collapses, some structures within the building (sturdy desks, filing cabinets, tables, and the like) may actually support a substantial portion of the roof or ceiling slightly above the floor, possibly saving a person from being crushed. It thus may also provide a rescue worker with a narrow passage through which to get to the trapped person. However, the sheer bulk of the SBCA can prevent such passage, and the rescue worker may be forced to remove the SCBA by unbuckling the waist belt and slipping off the shoulder straps. This is a cumbersome and time-consuming maneuver.

Furthermore, collapsing structures frequently present a space filled with a maze of wires, cables, structural building materials, and the like, and such environments carry a high risk of entanglement. When donning an SCBA, it is the SCBA itself that represents a particular risk. This is aptly described in the well known treatise on the subject, Firefighter Rescue & Survival, by Richard Kolomay and Robert Hoff, 2003, PennWell Corporation, pp. 88-95.

Thus, in some instances, to effect an escape, to make passage through a confined space possible, or to escape entanglement, it may be necessary to abandon the SCBA. When this dire action is taken, the rescue worker may be left without numerous tools and safety equipment disposed on his waist belt, and the rescue worker may be left without the means to carry critical gear other than by using his hands. This greatly handicaps the rescue worker and limits the tasks he can perform and the safety under which he can operate.

It would therefore be desirable to have means to rapidly release an SCBA unit from a waist belt while also retaining the waist belt with its attached tools and other accoutrements. While several firefighter/rescue worker support harnesses have been proposed to provide easy removal and adjustment, to the knowledge of the present inventor, none disclose, teach, or suggest a quick release system for selectively attaching and detaching a trucker's belt from an SCBA support frame.

BRIEF SUMMARY OF THE INVENTION

The present invention is an improved system for connecting or coupling an SCBA frame to a waist belt while also providing means for rapidly disconnecting or decoupling the SCBA from the waist belt while leaving the waist belt on the wearer. In its most essential aspect, the present invention is a quick release apparatus for selective connection and rapid disconnection of a rescue worker's waist belt from a self-contained breathing apparatus (SCBA) belt or frame. In a preferred embodiment, the apparatus includes three essential elements: the first is a belt connection apparatus that is connected to a wearer's waist belt; the second is an SCBA frame connection apparatus that is connected to the lower back support portion of an SCBA frame; and the third is a coupling apparatus for connecting the belt connection apparatus to the SCBA frame connection apparatus. The coupling apparatus includes at least one rapid release member that is pulled by the wearer to effect a very rapid disconnection of the belt connection apparatus from the SCBA frame connection apparatus. When the wearer pulls either one or two pullable rapid release members out and away from the SCBA frame, the SCBA is completely disconnected from the waist belt such that the wearer can remove the SCBA from his or her body while leaving the waist belt and any attached accoutrements in place. Thus, the wearer can jettison the SCBA essentially immediately, so as to improve mobility and maneuverability when the SCBA has become entangled or otherwise encumbers and endangers the user. At the same time the user retains the waist belt in the event it is needed as an essential element in a rapid egress harness and as a means for carrying tools that may yet be required.

In another preferred embodiment, the quick release system comprises coupling elements affixed to a fire fighters primary equipment belt that couple to the belt buckle components of an SCBA belt. Rather than buckling the SCBA buckle entirely around the waist, a wearer slightly shortens the SCBA belt and couples the SCBA waist belt buckles to complementary buckle elements attached to the equipment belt. Releasing the SCBA entirely from the waist involves nothing more than uncoupling the SCBA waist belt buckles from their complementary counterparts affixed to the equipment belt having the quick release system installed.

It is therefore a first and principal object of the present invention to provide a quick release system for selectively detaching a rescue worker SCBA frame from a hip/waist belt to which it is connected.

It is therefore an object of the present invention to provide a new and improved method and apparatus for rapid release and detachment of an SCBA breathing apparatus to facilitate unfettered movement in confined spaces.

It is another object of the present invention to provide a new and improved hip and waist belt connection apparatus for connecting the lower lumbar support member of an SCBA frame to a turnout gear hip and waist belt.

A further object or feature of the present invention is a novel method and apparatus for selective disengagement from an SCBA unit having safety features that require a conscious intention to remove the unit and prevent the inadvertent release of the unit.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIG. 3B is a partial front left perspective view showing the elements for connecting the lumbar support pad to the lumbar portion of an SCBA frame;

FIG. 3C is an upper left perspective view showing the lumbar pad connecting and secured with pins to the lumbar portion of the SCBA frame;

FIG. 4B is a top plan view corresponding to FIG. 3C;

DETAILED DESCRIPTION OF THE INVENTION

Figure 1:
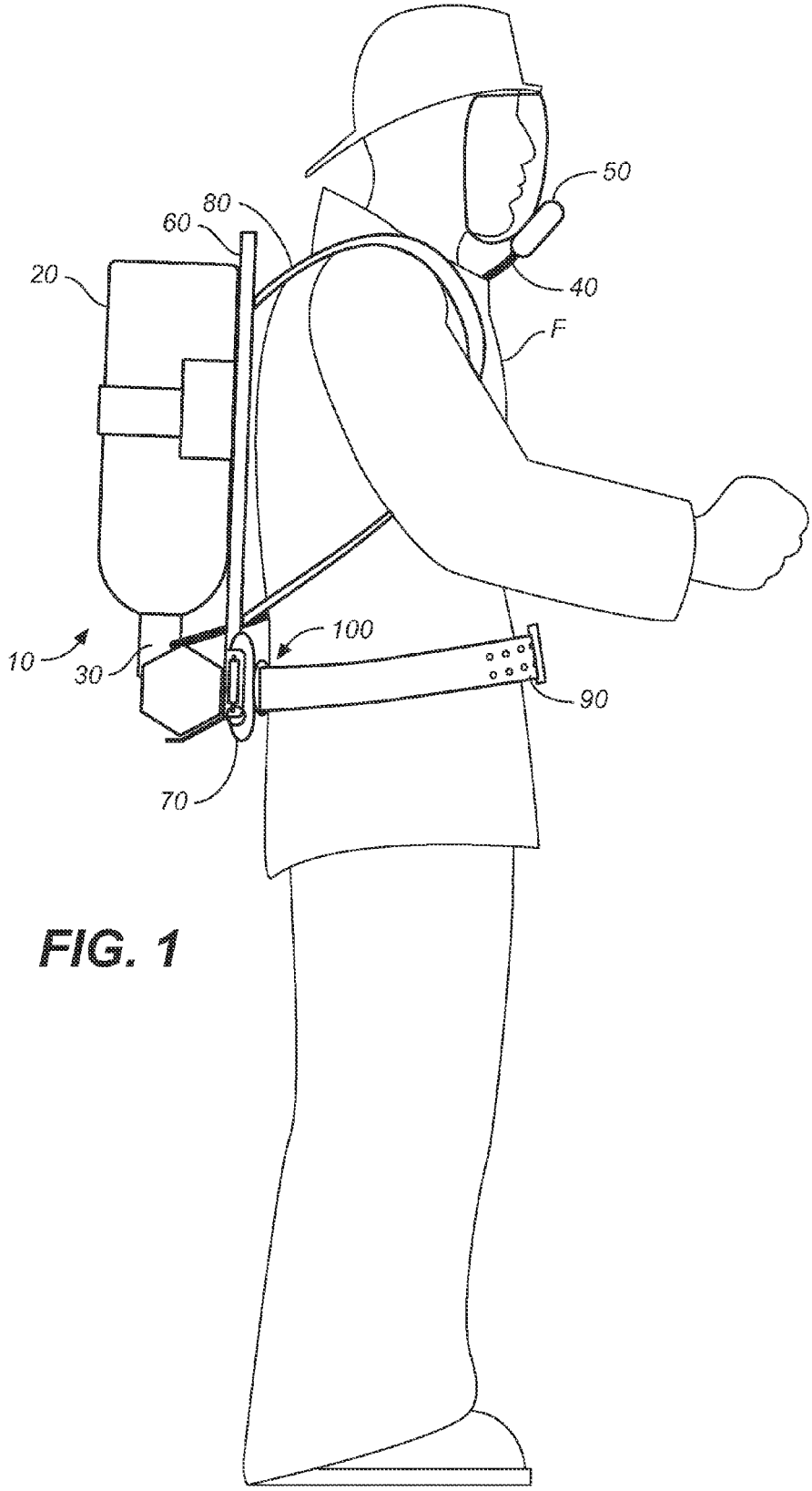
FIG. 1 is a schematic side view in elevation showing a firefighter wearing a self-contained breathing apparatus, which is attached at the lower lumbar support member of the SCBA frame to a trucker's belt using the quick release system of the present invention.

Referring first to FIGS. 1 through 4B, wherein like reference numerals refer to like components in the various views, there is illustrated therein a first preferred embodiment of a new and improved quick release apparatus for an SCBA frame, generally denominated 100 herein.

FIG. 1 shows a firefighter F wearing a self-contained breathing apparatus 10, which includes a tank 20 with a pressure regulator 30, an air line 40, and a protective inhalation face mask 50. The tank is mounted and supported on a rigid frame 60 having, among other things, a lower lumbar support plate 70 and shoulder straps 80. The frame is connected at its lower lumbar support plate to a trucker's belt 90 using the quick release apparatus of the present invention 100.

Figure 2A:
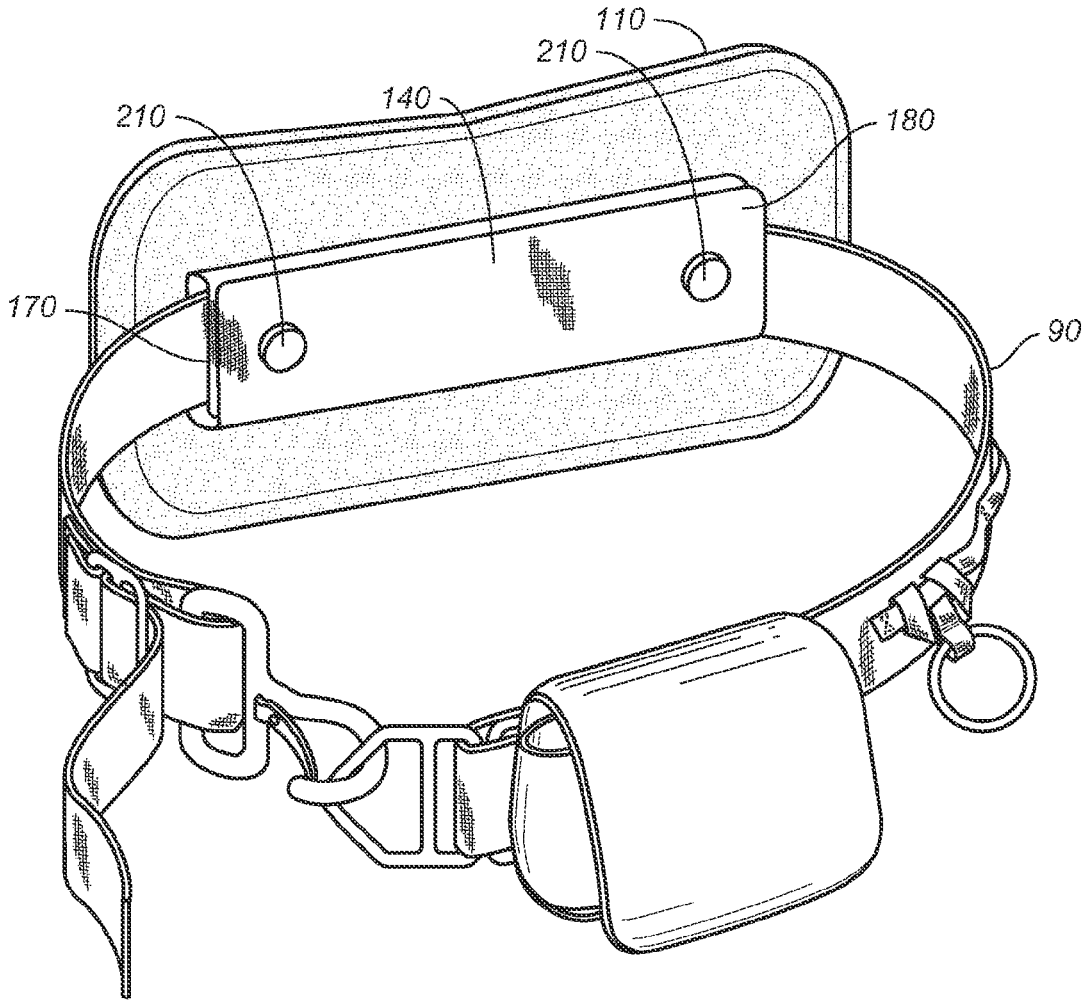
FIG. 2A is an upper front right perspective view showing the novel quick release system disposed on a trucker's belt.
Figure 2B:
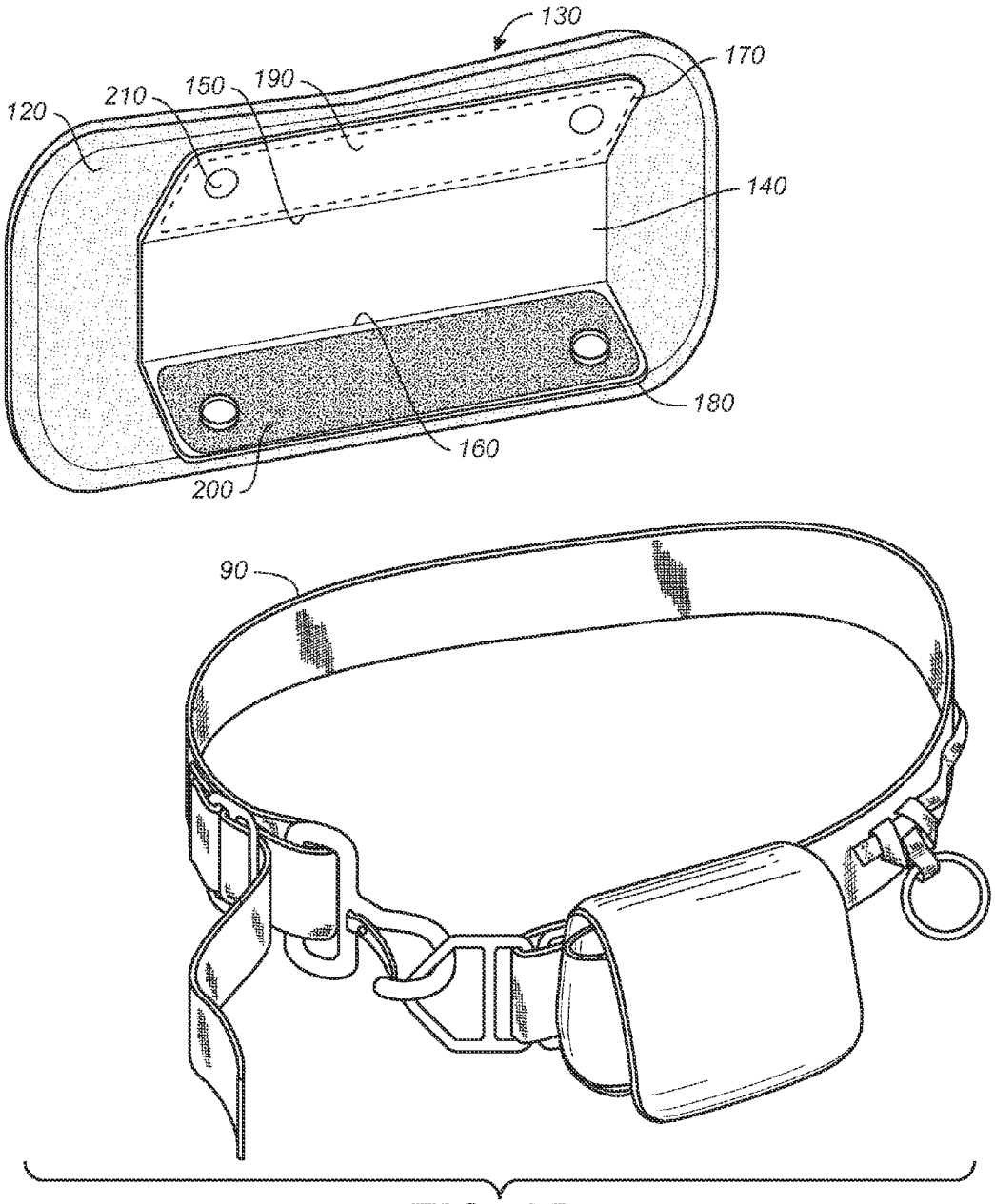
FIG. 2B is an upper front right perspective view of the lumbar support pad element detached from a trucker's belt.
Figure 3A:
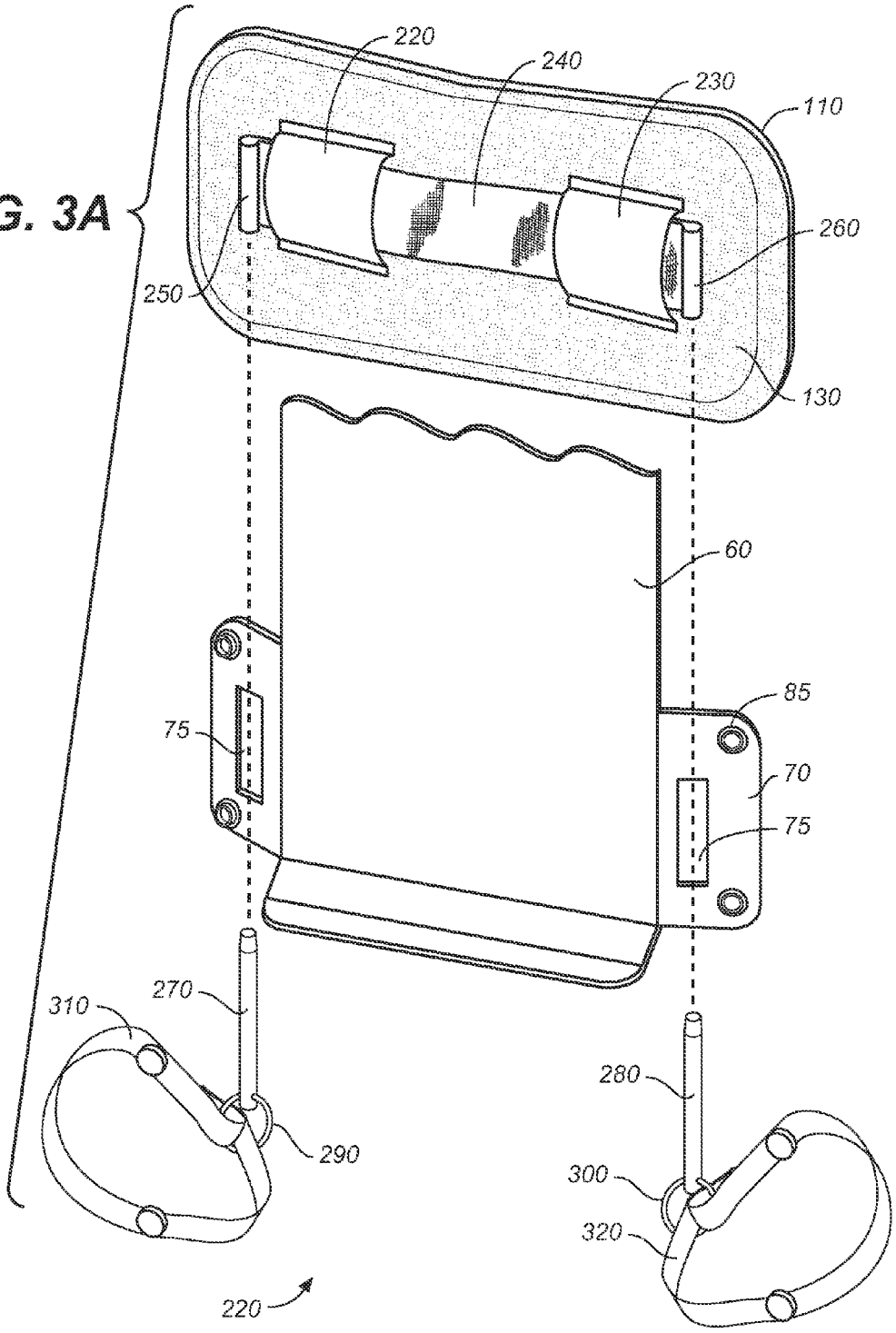
FIG. 3A is an upper front left exploded view of the quick release system for an SCBA frame of the present invention.
Figure 4A:
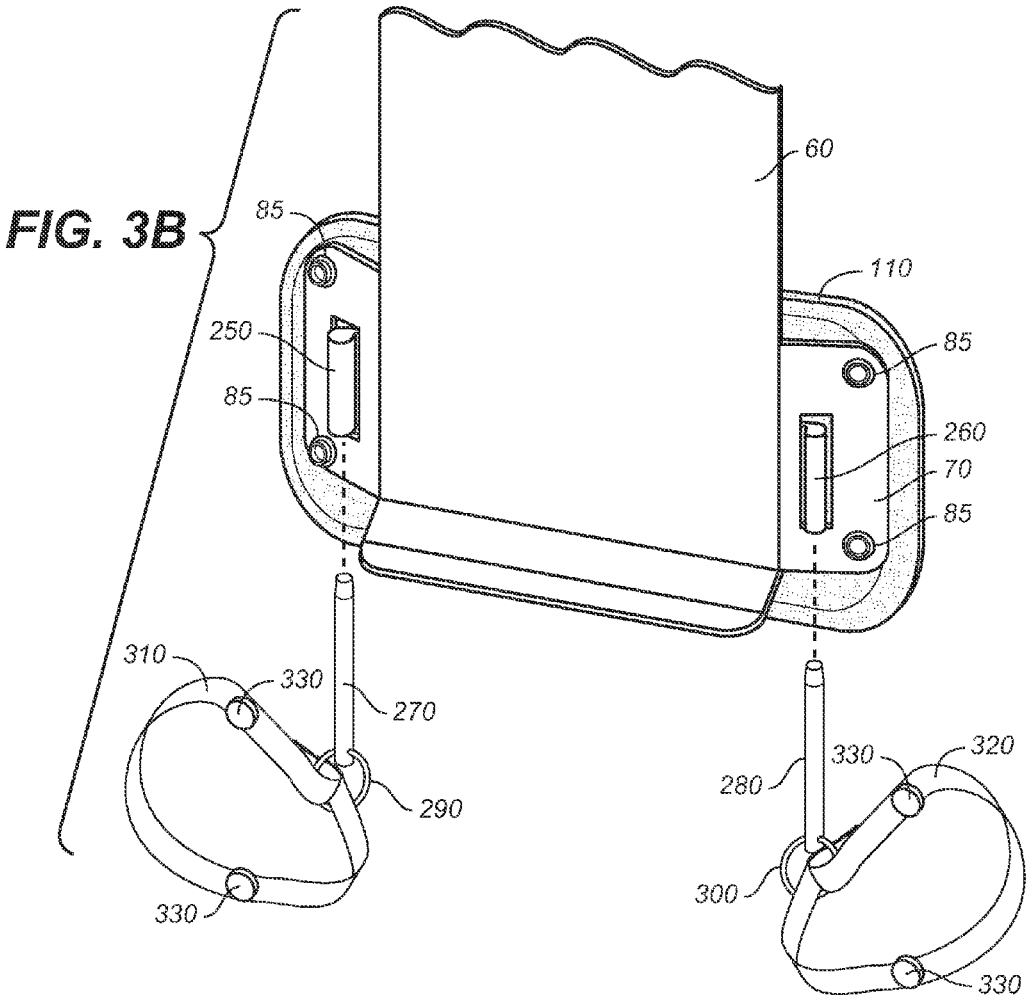
FIG. 4A is a top plan view corresponding to FIG. 3B.
Figure 4A:
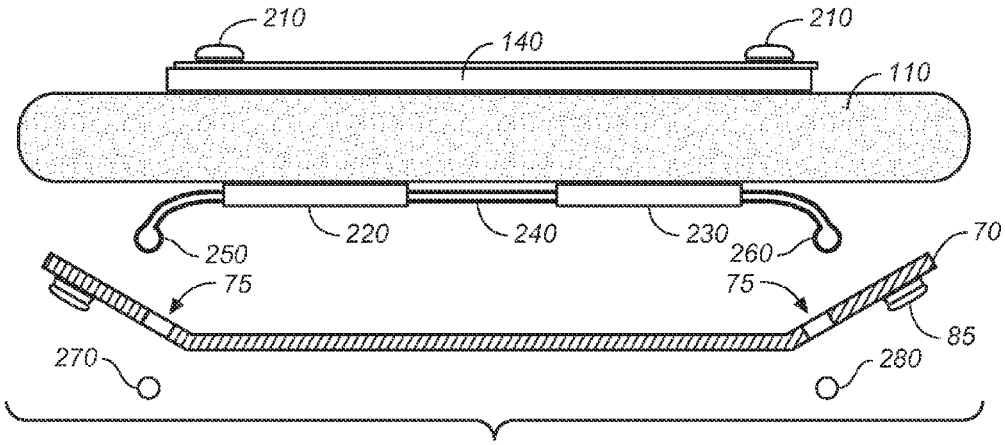

FIG. 2A is an upper right perspective view showing the lumbar pad portion of the novel quick release system releasably disposed on a rescue worker's belt (e.g., a trucker's belt), while FIG. 2B is the same view showing the lumbar pad portion detached from the belt. These views show the structural and operational features of a principal unit of the present invention and the general manner in which it is coupled to a trucker's belt 90. The elements include a generally rectangular frame-connecting lumbar support pad 110 for attachment to the interior side of the lower lumbar support plate 70. The lumbar support pad includes a front side 120, a rear side 130, and a selectively openable belt capturing sleeve 140 having an upper fold 150, a lower fold 160, upper and lower flaps, 170, 180, each having hook and loop fastener material, 190, 200, respectively (the former in phantom), and snaps 210. The frame-connecting lumbar support pad is preferably fabricated of aramid fiber webbing (such as KEVLAR® or NOMEX®) or other suitably sturdy natural or synthetic, heat and fire resistant material, and the webbing may cover a padding of some kind, according to the comfort needs and preferences of the wearer. [KEVLAR and NOMEX are both registered trademarks of E. I. du Pont de Nemours and Company.]

Referring now to FIGS. 3A through 4B, the frame-connecting lumbar support pad also includes frame connectors 220 for releasable connection to the SCBA lower lumbar support plate 70. It will be noted that the SCBA lower lumbar support plate must be modified and adapted to accommodate the frame connectors, and such modification preferably includes the provision of two generally vertically disposed slots 75 and the provision of snap elements 85 riveted to the SCBA frame.

In the preferred embodiment, the frame connectors comprise first and second fabric sleeves 220, 230 sewn into the rear side 130 of the lumbar pad 110, a strap 240 inserted through the sleeves and having loop ends 250, 260 adapted for insertion through slots 75 and to accommodate removable pins 270, 280, which, when inserted through the loop ends of strap 240 affixes the lumbar pad to the SCBA frame and effectively prevents removal of the lumbar pad unless the pins are removed from the loop ends. The lower ends of each pin includes a pin ring 290, 300, to which a pull strap 310, 320 is attached, and a snap element 330 is disposed along the length of each of the pull straps. The snap elements mate with corresponding snap elements riveted to the SCBA frame to prevent inadvertent removal of the pins from the loop ends.

As will be readily appreciated, installation of the quick release system is a simple matter. First, the loop ends 250 and 260 are inserted through slots 75, and pins 270, 280 are inserted into the bottom opening of the loop ends. Next, snap elements 330 on pull straps 310, 320 are mated to the corresponding snap elements 85 on the lumbar support 70 of SCBA frame 60. At this point, the lumbar pad is fully installed on the SCBA frame.

Next, to connect the SCBA frame to a trucker's belt, the belt-capturing member 140 is opened and a length of the trucker's belt is placed between the upper and lower folds 150, 160. The upper and lower flaps 170, 180, are folded over, pressed together to approximate the hook and loop fastener surfaces, and the flaps are then snapped shut using snaps 210.

If a firefighter encounters a situation in which his safety could depend upon quickly jettisoning the SCBA and its frame while still keeping the trucker's belt and any gear carried on the belt, he need only grab pull straps 310, 320 to release snaps 330 and then pull the pins 270, 280 downwardly and out of loop ends 250, 260. Once the pins are pulled, the SCBA frame is physically released from the waist belt and the firefighter need only slip off the shoulder straps to free himself from the SCBA unit. The trucker's waist belt remains around his waist and provides easy access to any tools the worker has carried on his person into the perilous circumstances.

Referring next to FIGS. 5 through 11C, wherein like reference numerals refer to like components in the various views, there is illustrated therein a second preferred embodiment of the new and improved quick release apparatus for an SCBA frame, generally denominated 500 herein.

Figure 5:
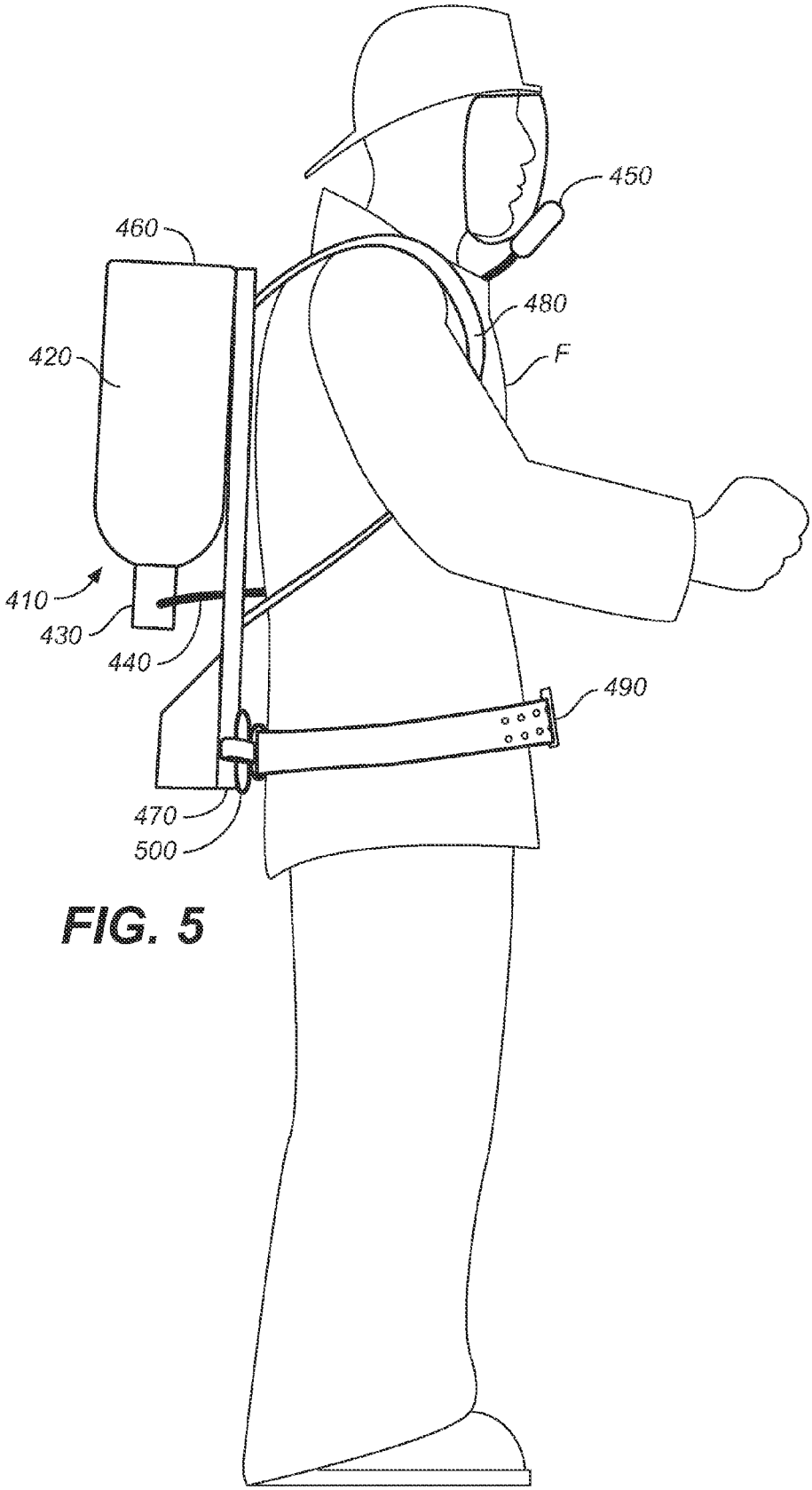
FIG. 5 is a schematic side view in elevation showing a firefighter wearing a second preferred embodiment of the self-contained breathing apparatus of the present invention, again showing the apparatus attached at the lower lumbar support member of the SCBA frame to a trucker's belt using the quick release system of the present invention.

FIG. 5 shows a firefighter F wearing a self-contained breathing apparatus 410, which includes a tank 420 with a pressure regulator 430, an air line 440, and a protective inhalation face mask 450. The tank is mounted and supported on a rigid frame 460 having, among other things, a lower lumbar support plate 470 and shoulder straps 480. The frame is connected at its lower lumbar support plate 470 to a trucker's belt 490 using the quick release apparatus of the present invention 500.

Figure 6A:
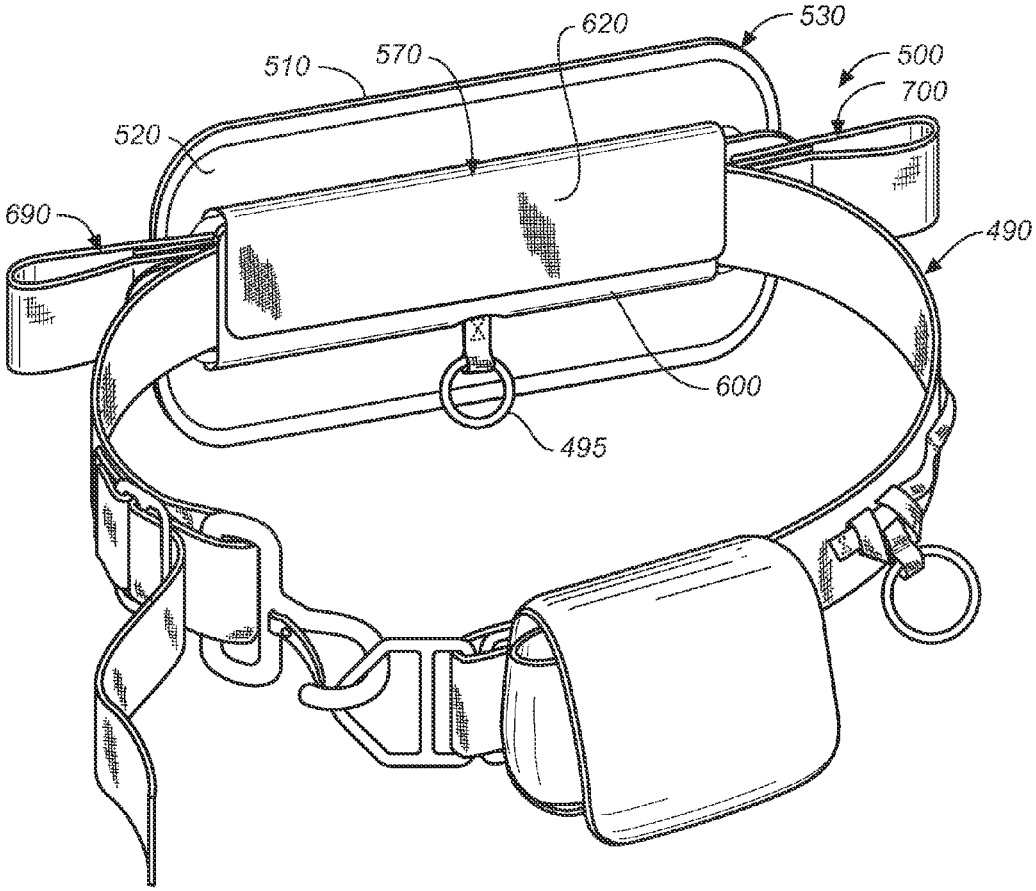
FIG. 6A is a perspective view showing the second preferred embodiment disposed on a trucker's belt.
Figure 6B:
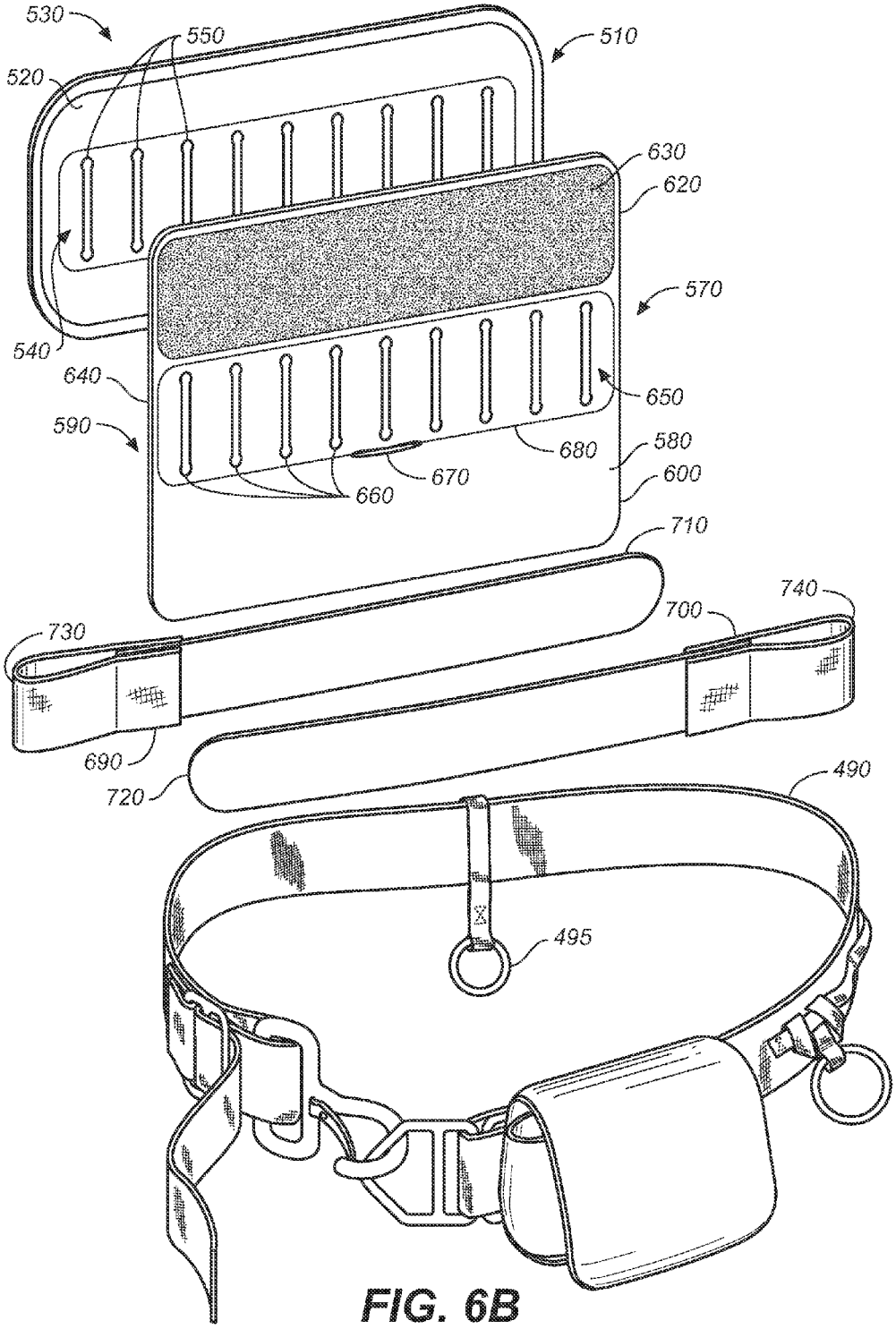
FIG. 6B is an exploded view thereof.

FIG. 6A is a perspective view showing the second preferred embodiment of the novel quick release system disposed on a trucker's belt, while FIG. 6B is an exploded view thereof. These views show the structural and operational features of the present invention and the general manner in which the quick release apparatus is coupled to a trucker's belt 490. The elements include a generally rectangular frame-connecting lumbar support pad 510 having a front side 520, a rear side 530, and a medial longitudinally disposed linear array of loops 540 defined by spaced-apart parallel slots 550 cut into the front side. The frame-connecting lumbar support pad is preferably fabricated of the same materials as that of the first preferred embodiment, namely, aramid fiber webbing or another sturdy natural or synthetic, heat and fire resistant material. Further, the addition of padding is an option, albeit a desirable one.

Figure 8A:
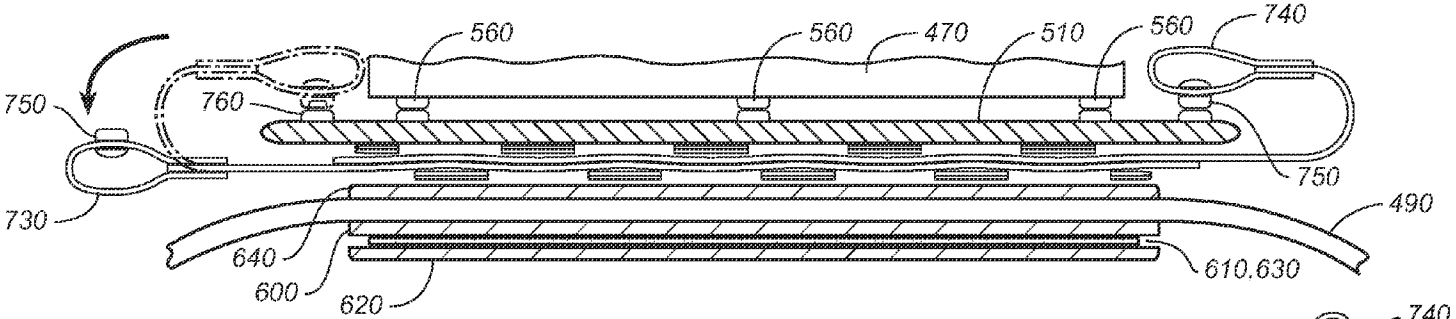
FIG. 8A is a cross-sectional top view taken along section line 8-8 of FIG. 7A, showing the frame-connecting member disposed on an SCBA lumbar support member, and the belt connection member of the second preferred embodiment demountably interwoven to the frame-connecting member using first and second quick release straps (one strap is shown unsnapped from the frame-connecting member and poised for removal)
Figure 8B:
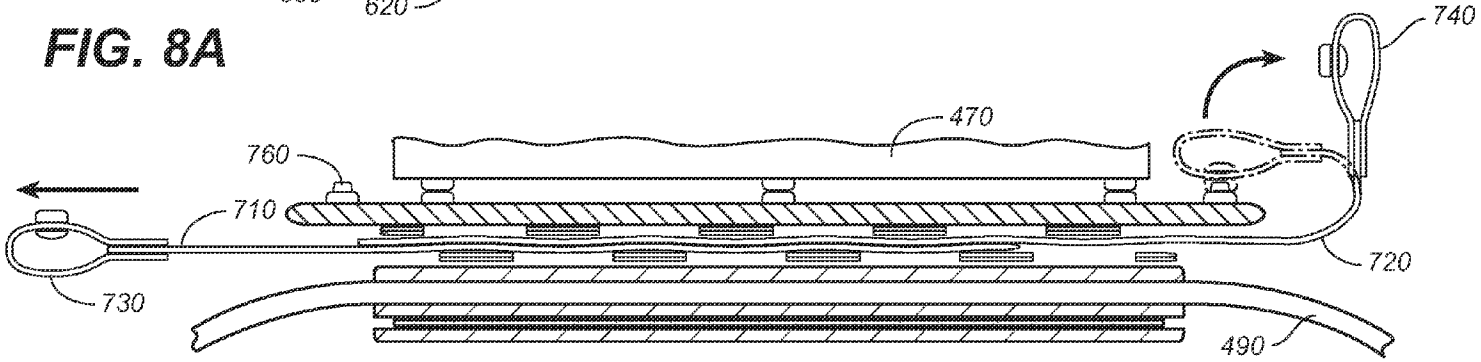
FIG. 8B is a cross-sectional top view taken along section line 8-8 of FIG. 7A, showing one quick release strap being slidably removed while a second quick release strap is unsnapped and positioned for removal.
Figure 8C:
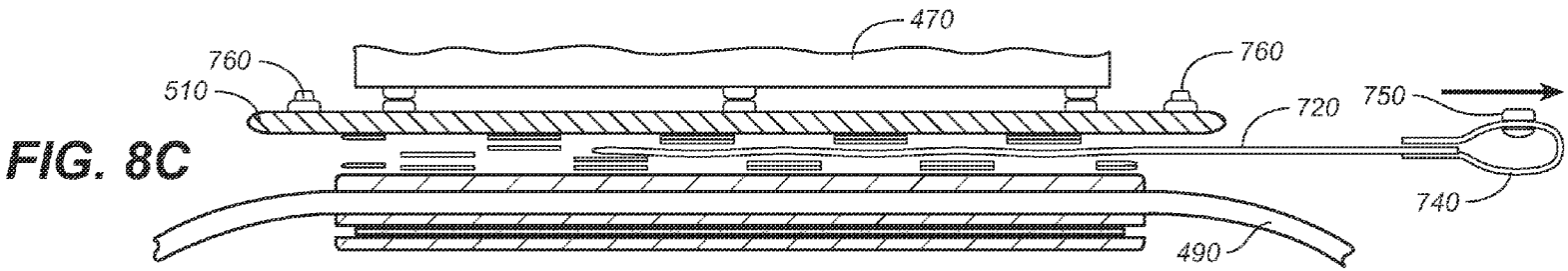
FIG. 8C is a cross-sectional top view taken along section line 8-8 of FIG. 7A, showing the second quick release strap being slidably removed.
Figure 8D:
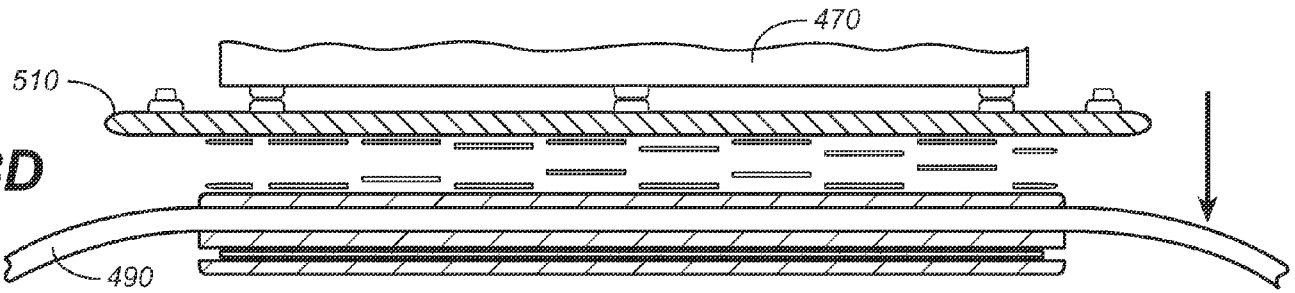
FIG. 8D is a cross-sectional top view taken along section line 8-8 of FIG. 7A, showing both quick release straps fully removed and the belt connection member and trucker's belt separating from the frame-connecting member and SCBA frame.
Figure 8E:
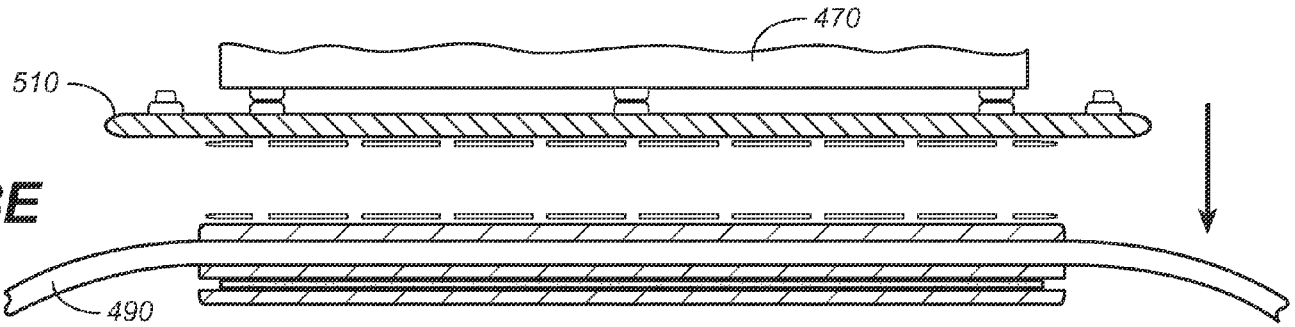
FIG. 8E is a cross-sectional top view taken along section line 8-8 of FIG. 7A, showing further separation of the belt-capturing member and belt from the frame-connecting member and frame.
Figure 8F:
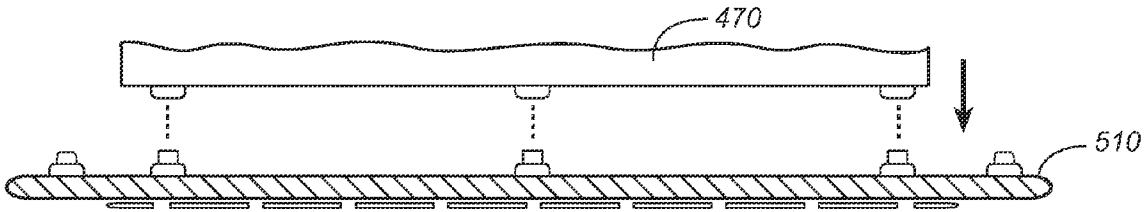
FIG. 8F is a cross-sectional top view taken showing the frame-connecting member being detached from the SCBA frame lower lumbar support plate.

Referring now to FIGS. 8 through 8F, the frame-connecting lumbar support pad also includes a plurality of frame connectors 560 for releasable connection to the SCBA lower lumbar support plate 470. The frame connectors may include one-way snaps, rivets, bolts, and the like, and the frame-connecting member may also be tailored and configured to include foldable elements which fold around and cooperate with structural elements of the lower lumbar support to provide a secure connection between the frame-connecting lumbar support pad and the lower lumbar support that will not become inadvertently disconnected during use. In the views, simple snaps are shown by way of illustration only, but such should be understood to comprise a schematic representation of the kinds of connectors described and well known in the art.

Figure 9A:
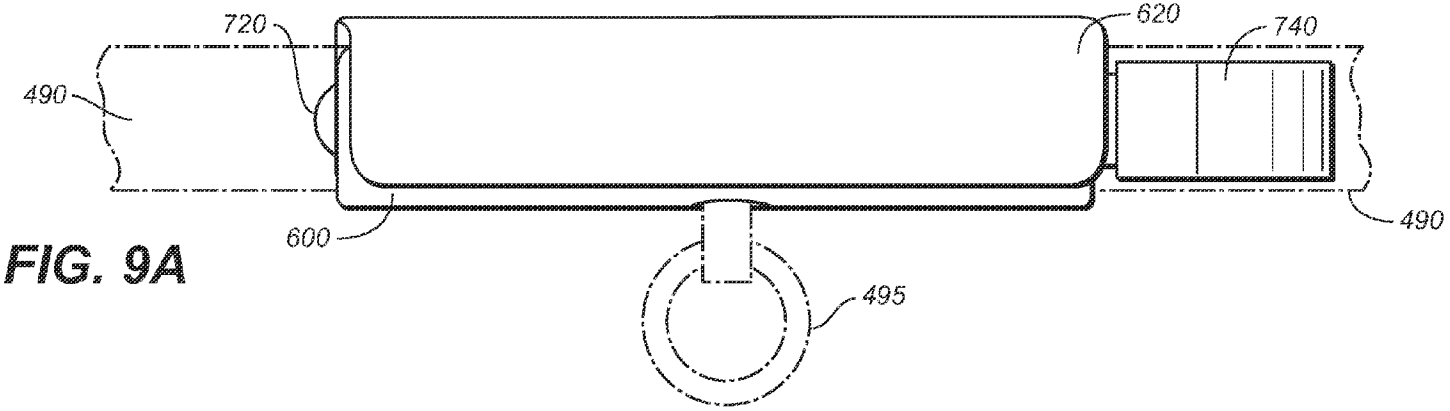
FIG. 9A is a front view in elevation showing the belt-capturing member foldably capturing a trucker's waist belt, one quick release strap slidably inserted into the loop connection elements.
Figure 9B:
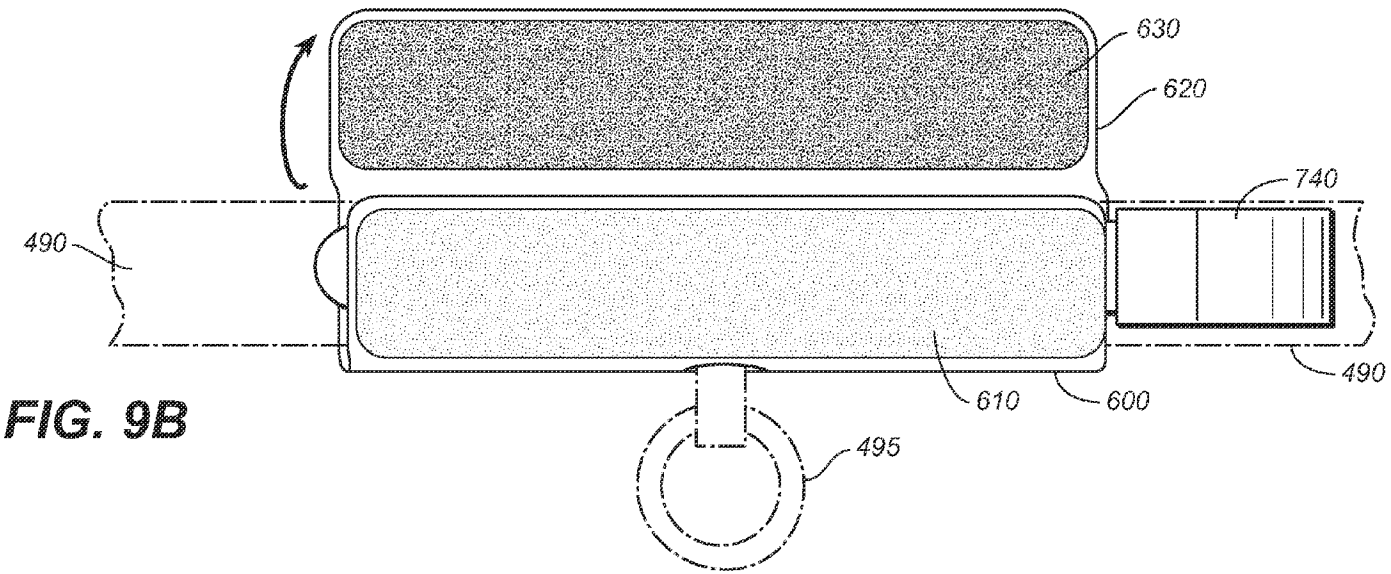
FIG. 9B shows the exterior flap of the belt-connection member opened.
Figure 9C:
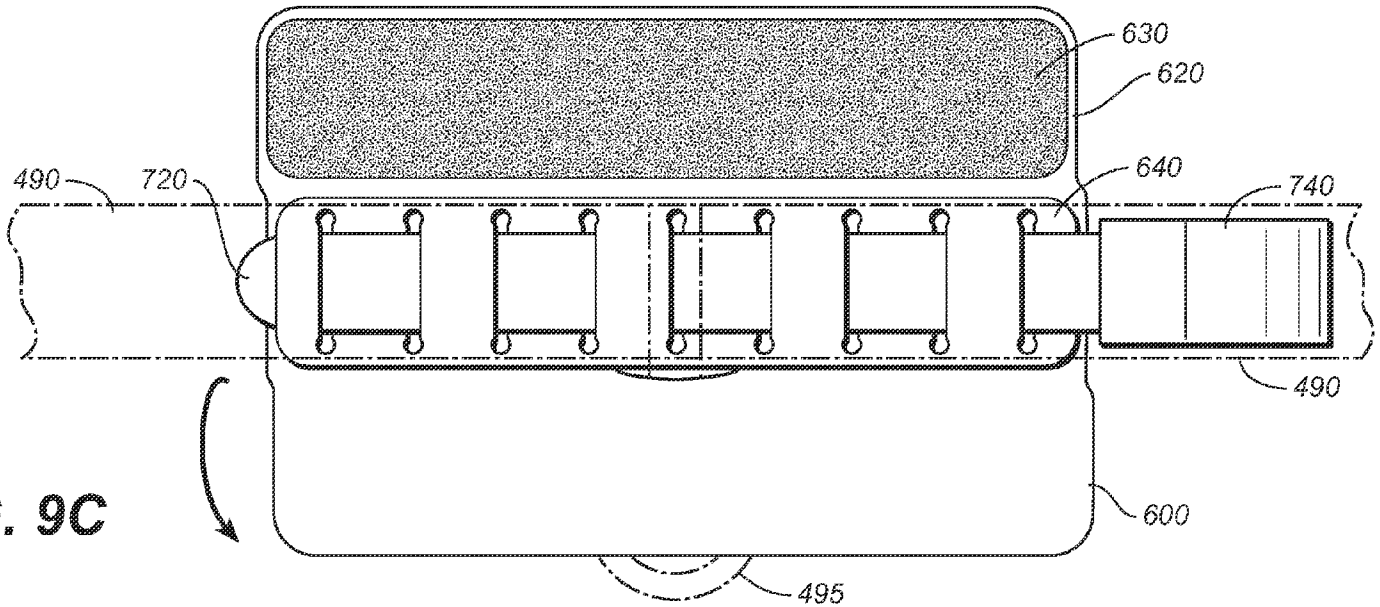
FIG. 9C shows the interior flap of the belt-connection member opened, exposing the loop connection elements and the single quick release strap slidably inserted into the loop connection elements.
Figure 10:
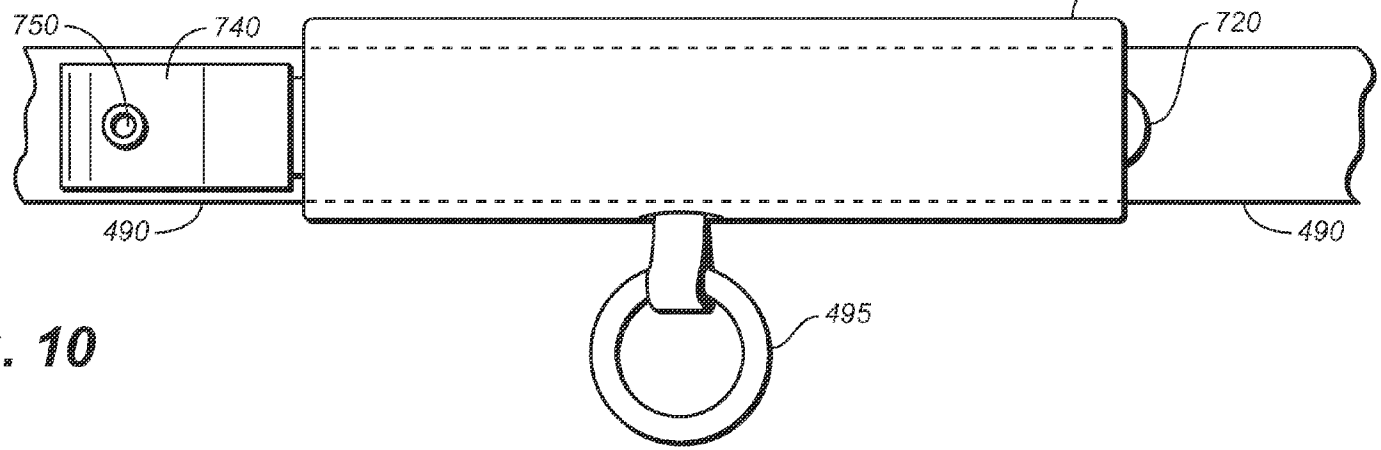
FIG. 10 is a rear view in elevation of the belt-connection member as shown in FIG. 9A.
Figure 11A:
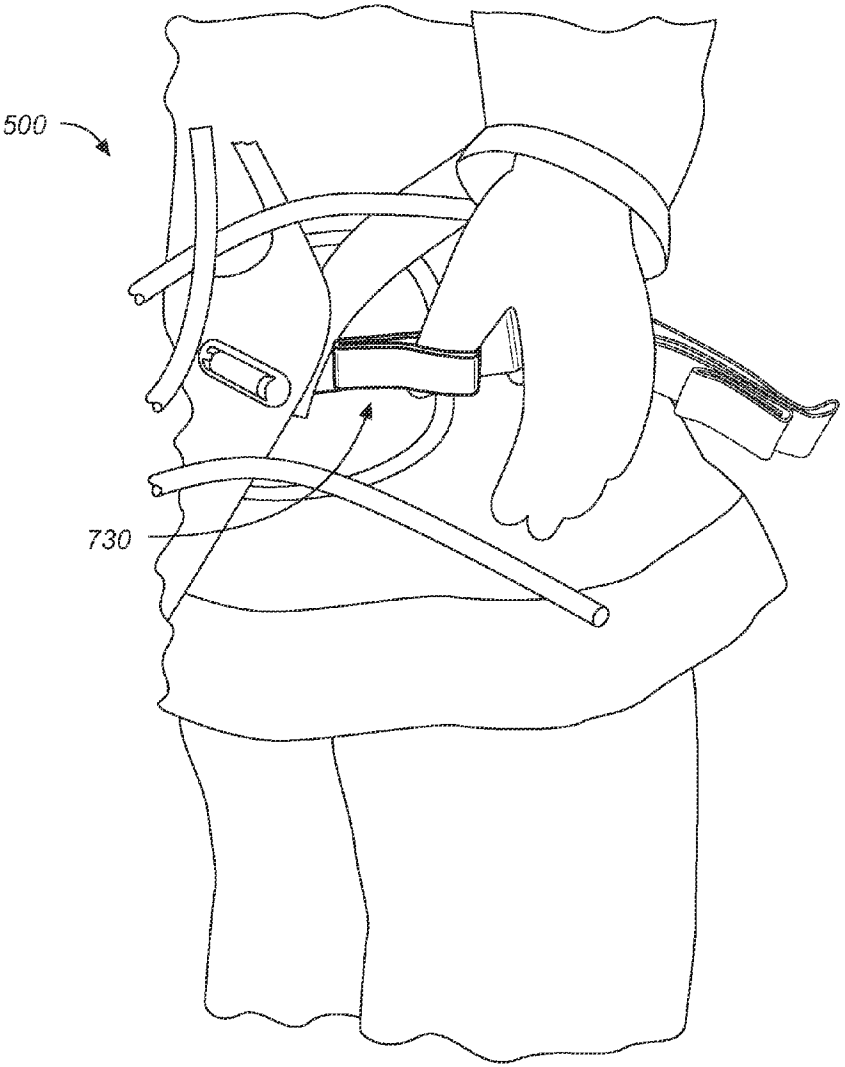
FIGS. 11A-C are upper rear perspective views showing detail of a firefighter pulling out one quick release strap from the quick release apparatus of the present invention while donning an SCBA unit.
Figure 11B:
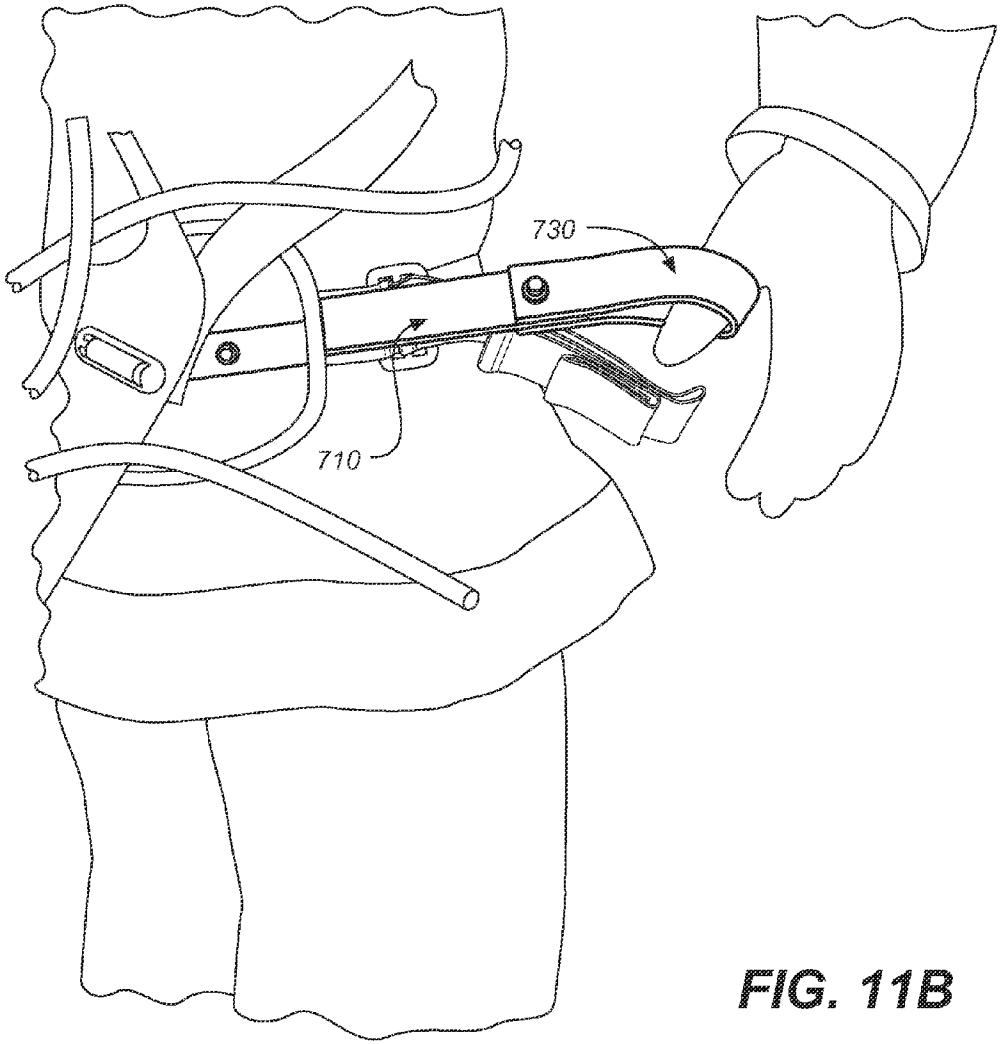
Figure 11C:
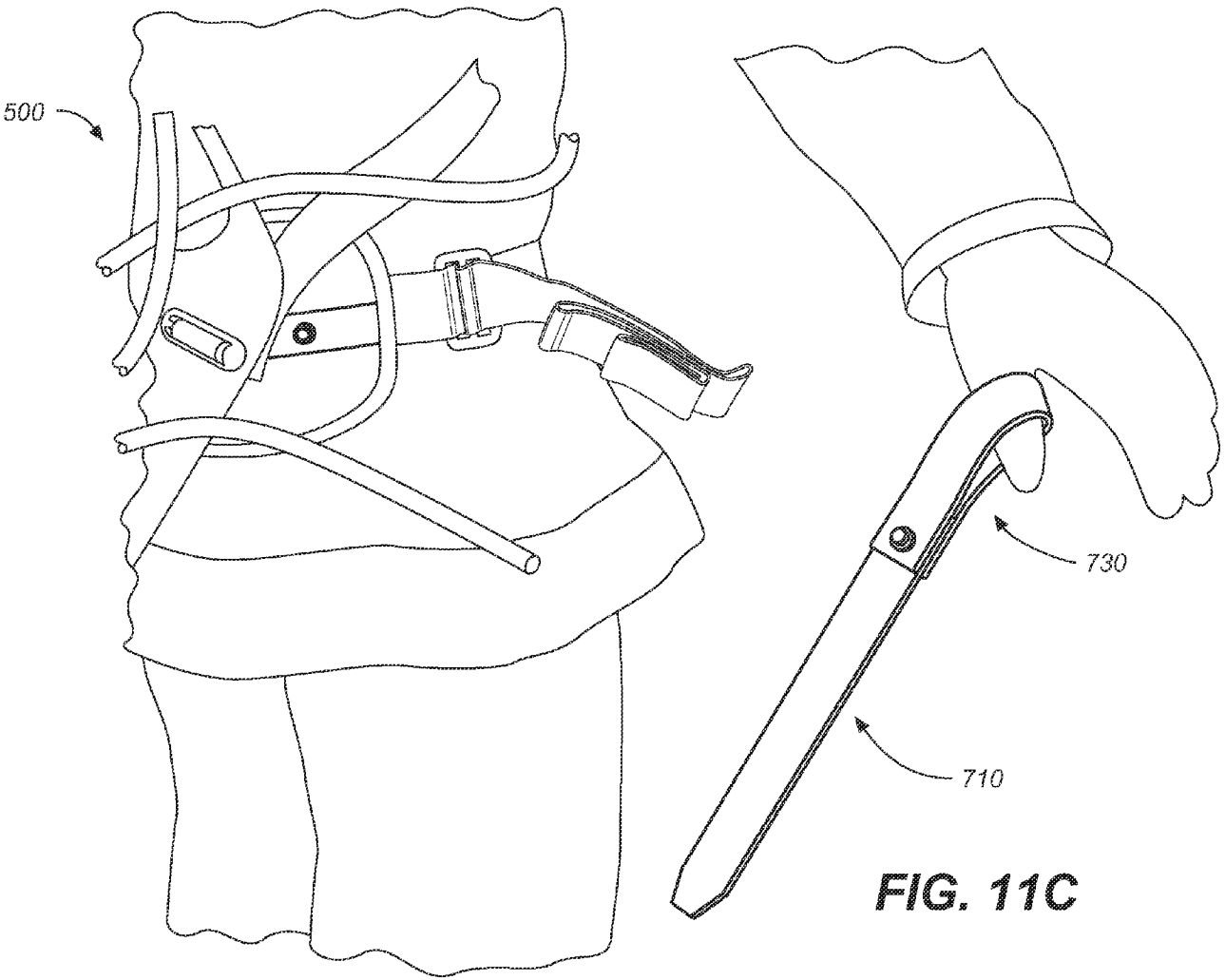

Still referring to FIGS. 6A and 6B, and now also to FIGS. 9A through 10, the quick release system next includes a generally rectangular belt-capturing member 570 having a front side 580, a rear side 590, a lower (interior) flap 600 having hook and loop material 610 disposed on the rear side, an upper (exterior) flap 620 having hook and loop material 630 disposed on the front side that is complementary to the hook and loop material on the lower flap, and a medial portion 640 having a longitudinally disposed array of loops 650 defined by spaced-apart parallel slots 660. A hole or slot 670 may be cut along the lower flap fold 680 through which a tool ring and strap 495 sewn onto the trucker's belt may be inserted. This configuration provides means to prevent slippage of the belt-capturing member when worn.

The apparatus next includes at least one, and preferably two, quick release straps, 690, 700. Each strap includes a semi-flexible smooth plastic or metal planar portion 710, 720, respectively, and a loop or handle 730, 740, respectively, at its outboard end.

Figure 7A:
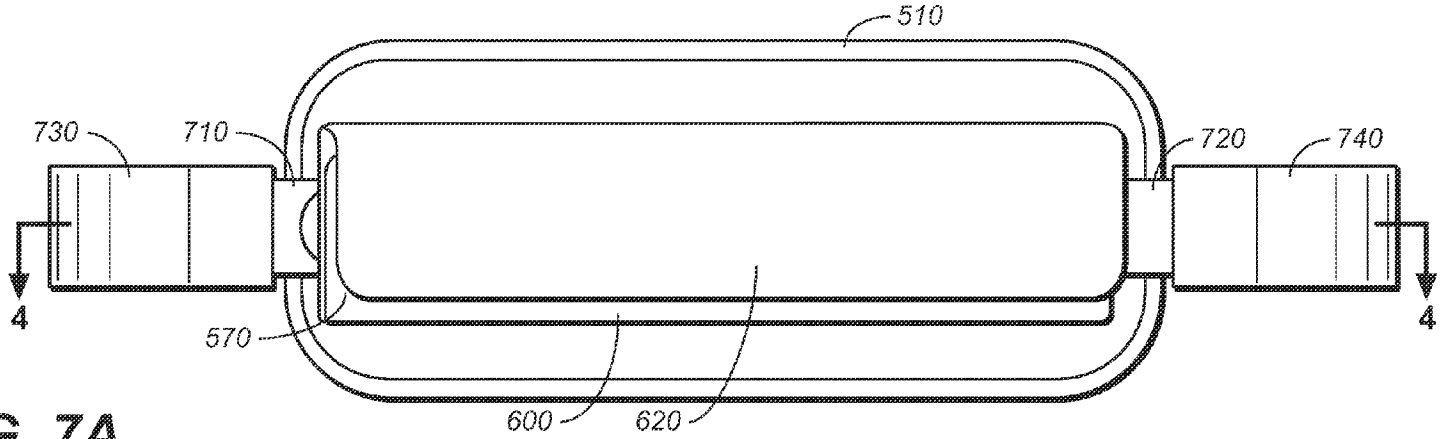
FIG. 7A is a front view in elevation of the second preferred embodiment of the quick release system for an SCBA frame of the present invention.
Figure 7B:
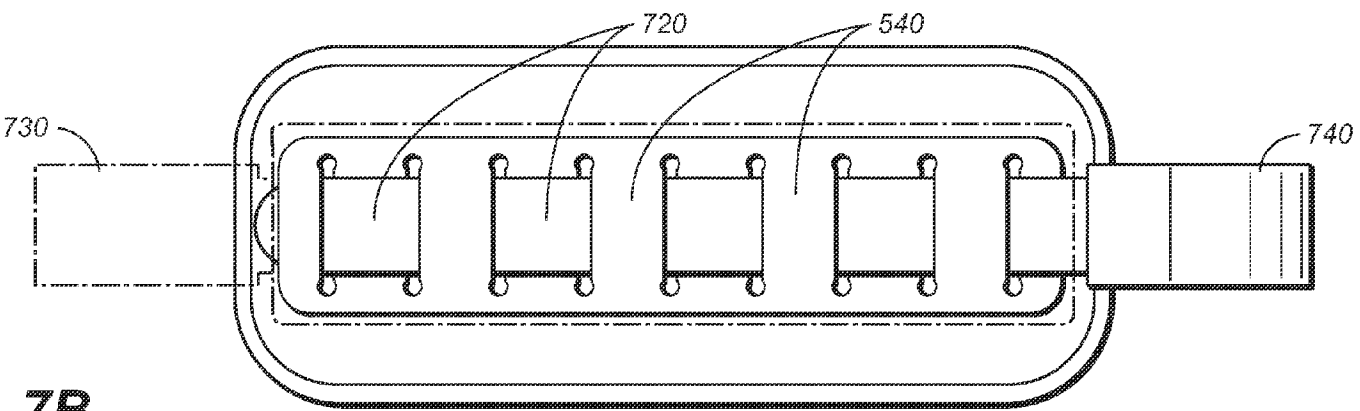
FIG. 7B is a front view in elevation showing the SCBA lumbar support frame-connecting member of the inventive apparatus, with one quick release strap removed.

FIG. 7A is a front view in elevation of the quick release system for an SCBA frame of the present invention, showing the belt-capturing member demountably coupled to the frame-connecting lower lumbar support pad, and both quick release straps inserted into the entire array of interwoven loops. FIG. 7B is the same view with the belt-capturing member and one quick release strap removed, the removed elements each shown in phantom lines.

As will be readily appreciated by reference now to FIGS. 8A through 8F, the belt-capturing member is selectively and demountably attached to the lower lumbar support pad by approximating the frame-connecting lower lumbar support pad front side and the belt-capturing member rear side and threadably inserting one or both of the straps through the parallel slots in each member in an interchanging sequence. This effectively interweaves the loops in the two elements. For increased security and to prevent the quick release straps from being inadvertently pulled out from the attached elements, snaps or other connection apparatus 750 may be disposed on the quick release handles for connection to a complementary connector or structure 760 on the frame-connecting lower lumbar support pad.

Referring now to both FIGS. 8A through 8F and FIGS. 11A through 11C, it will be seen that the belt-capturing member is rapidly released from the frame-connecting lower lumbar support pad (and thus from the SCBA unit) simply by uncoupling the quick release strap handles and pulling them outwardly and away from one another, i.e., away from the body of the wearer and in opposite directions.

Turning next to FIGS. 12-13B and FIGS. 15A-15B, there is shown a third preferred embodiment 800 of the inventive quick release system. This embodiment includes as a first principal element a male belt block 810 having a horizontally disposed belt passageway 820 and an outer surface 830 with an integral rivet-shaped post 840 having a shaft 850 and a head 860. A belt 870 is inserted through the belt passageway such that the male belt block is worn directly behind the wearer in the lumbar region of the back.

The second principal element is a female frame mounted member 880 which includes mounts 890, 900 for screwing or otherwise connecting the frame mounted member to an SCBA frame. The mounts are attached to the outer surface 910 of a base 920 which includes a central opening 930 in the central portion of the base and a cylindrical receiver cup 940 in which are disposed a helical compression spring 950 with a slidable plate 960 engaging the inner end 970 of the spring. The outer end 980 of the spring is urged against the bottom 990 of the receiver cup. The plate moves axially within the cylindrical cup in response to pressure and is prevented from ejection from the cup by a retention ring 1000 formed on the inner end 1010 of the receiver cup. The receiver cup is preferably transparent so as to function as a window which enables the user to see when the system is properly coupled.

The female frame mounted member next includes first and second slots 1020, 1030 disposed in its ends 1040, 1050, and into which are slidably inserted first and second spring-loaded pull bars 1060, 1070. The pull bars each include a window 1080, 1090, which encompasses a flat wire tension spring 1100, 1110, one end of which 1120, 1130 is bent and anchored in an anchor point 1140, 1150 recessed in the interior wall formed by the slot.

The inboard ends 1160, 1170 of the pull bars each terminate in a semicircular jaw 1180, 1190. The pull bars are loaded and urged to slide inwardly by the flat wire tension springs 1100, 1110, such that when post 840 is inserted through the central opening 930 and pushed into receiver cup 940, the semicircular jaws 1180, 1190 engage the shaft 850 of the post immediately below the post head 860 to capture and retain the male belt block 810. This places the quick disconnect system in the coupled configuration. Accordingly, this embodiment of the inventive system provides yet another means to couple an SCBA frame to a rescue worker's or firefighter's waist belt while also providing a way to rapidly uncouple the SCBA frame from the waist belt—in this instance by simply pulling straps 1200, 1210 disposed on the outboard ends of the pull bars. Indeed, in this embodiment, the spring 950 in receiver cup 940 facilitates the decoupling by effectively ejecting the post 840 from the receiver cup when the pull bar jaws are disengaged by pulling the straps outwardly from the slots (i.e., laterally relative to the user). The SCBA frame can be rapidly reconnected or re-coupled by pulling the pull bars laterally and pushing the male post back into the receiver cup.

Figure 12:
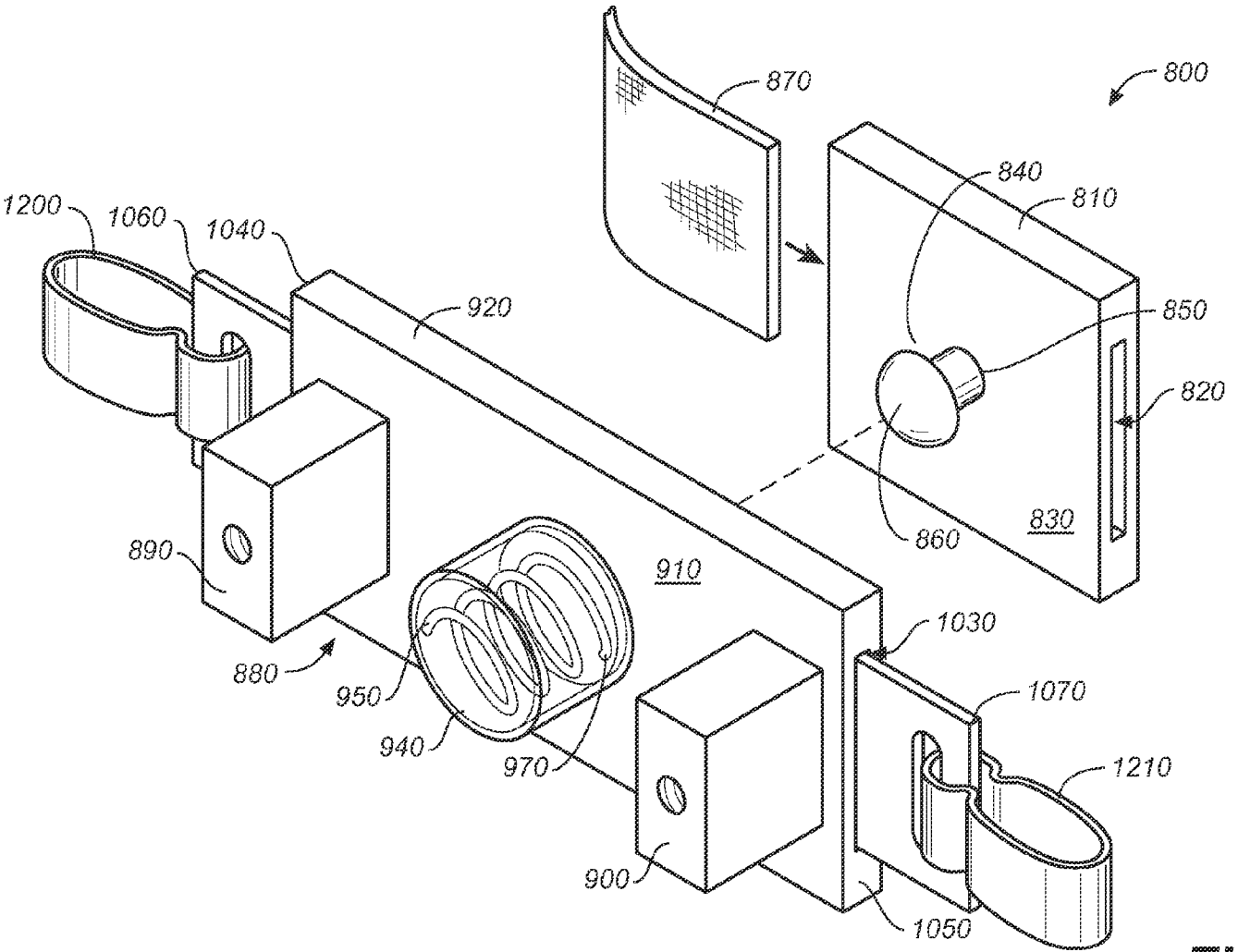
FIG. 12 is an upper perspective view showing a third preferred embodiment of the quick release system of the present invention.
Figure 13A:
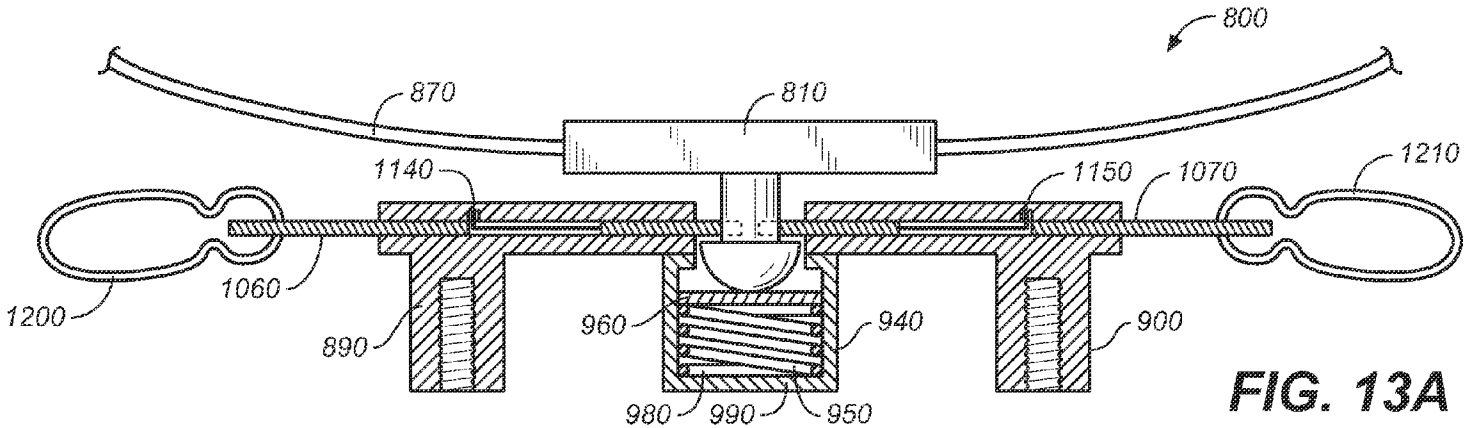
FIG. 13A is a cross-sectional top plan view showing the quick release system in the coupled configuration.
Figure 13B:
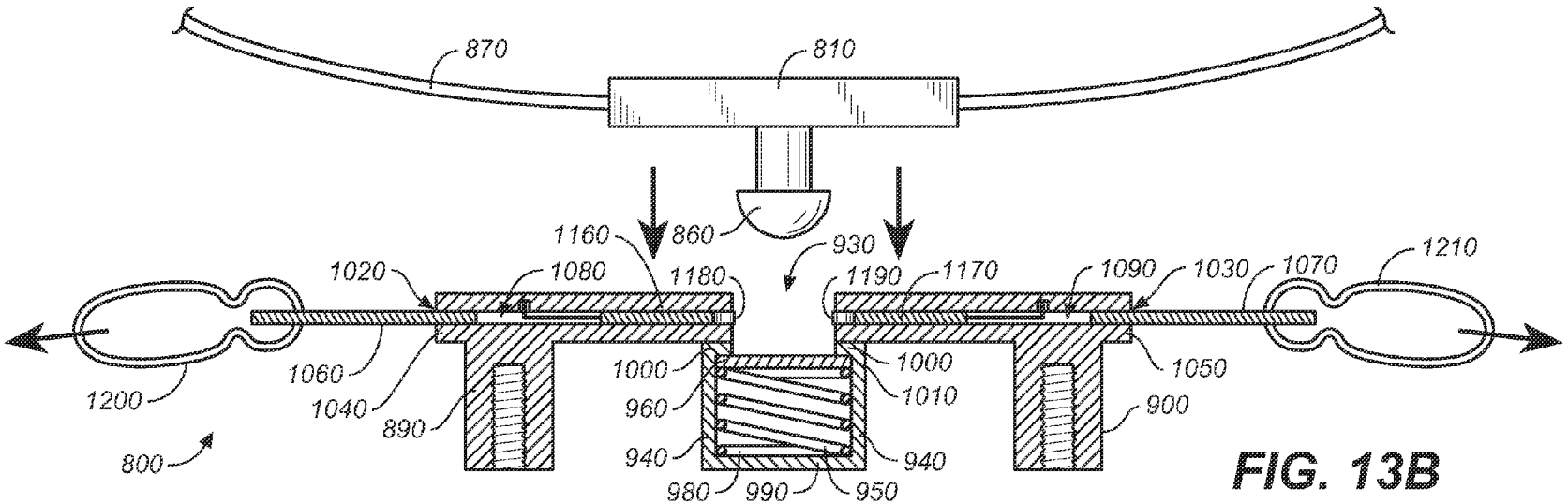
FIG. 13B shows the system of FIG. 13A decoupled.
Figure 14A:
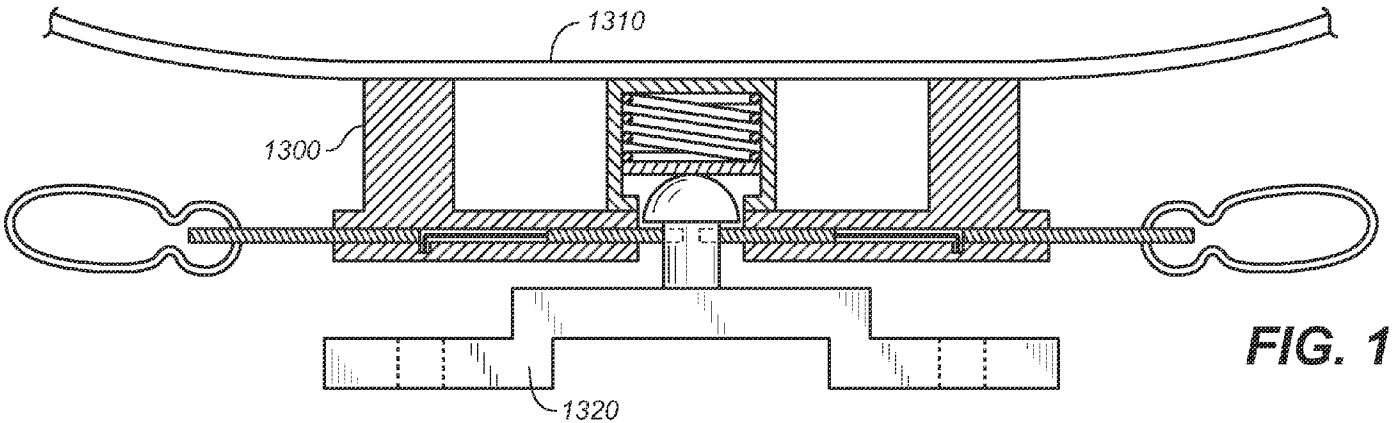
FIG. 14A is a top plan view showing a fourth preferred embodiment of the inventive apparatus, showing the system in the coupled configuration.
Figure 14B:
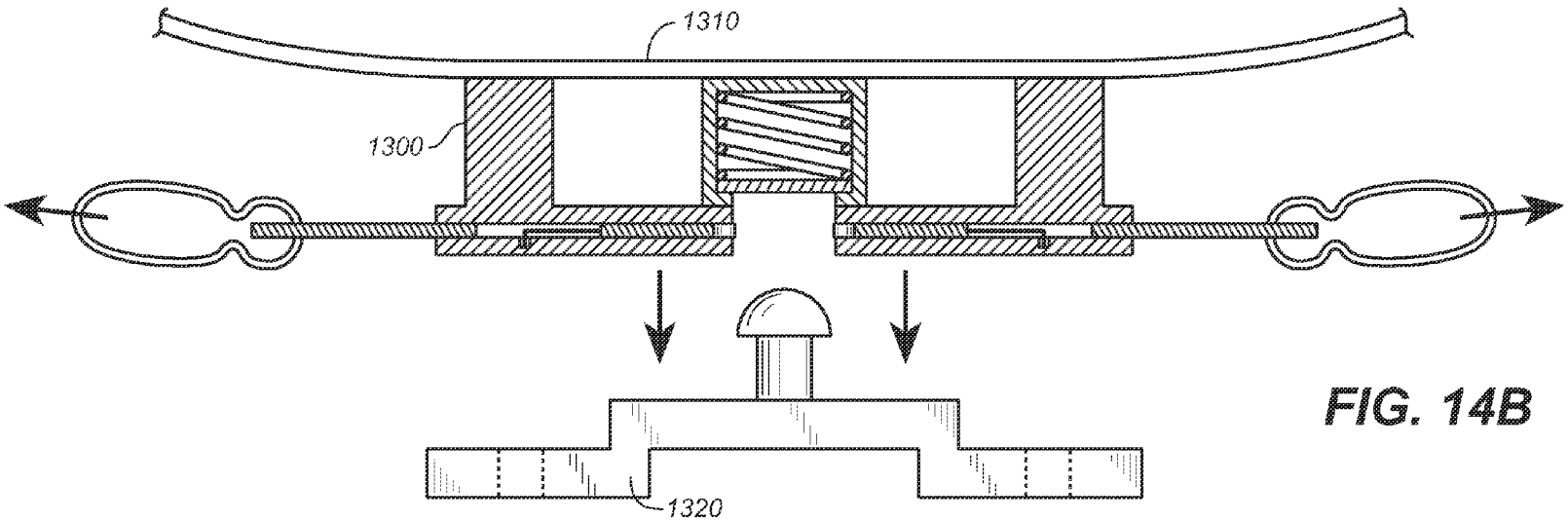
FIG. 14B shows the system of FIG. 14A in the decoupled configuration.

FIGS. 14A-14B show the same system as that of FIGS. 12-13B, except that the structural relationship of the female and male members are reversed, with the female member 1300 being mounted on the wearer's belt 1310 and the male member 1320 being configured for mounting on an SCBA frame. In every other respect, the system of this embodiment is identical to that of the system shown in FIGS. 12-13B.

Figure 15A:
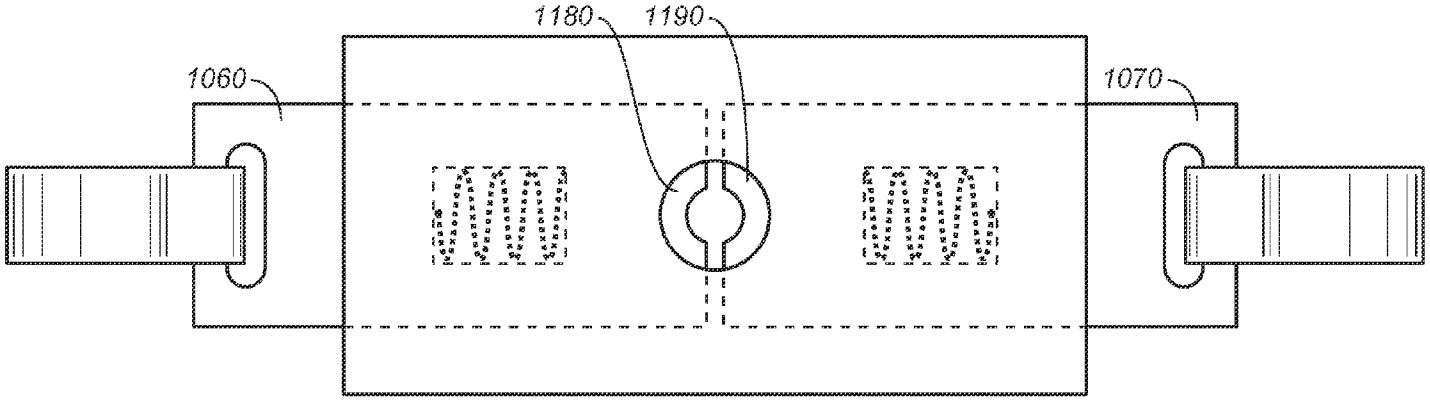
FIGS. 15A-15B are front views in elevation showing the operative principle of the systems of FIGS. 12-14B.
Figure 15B:
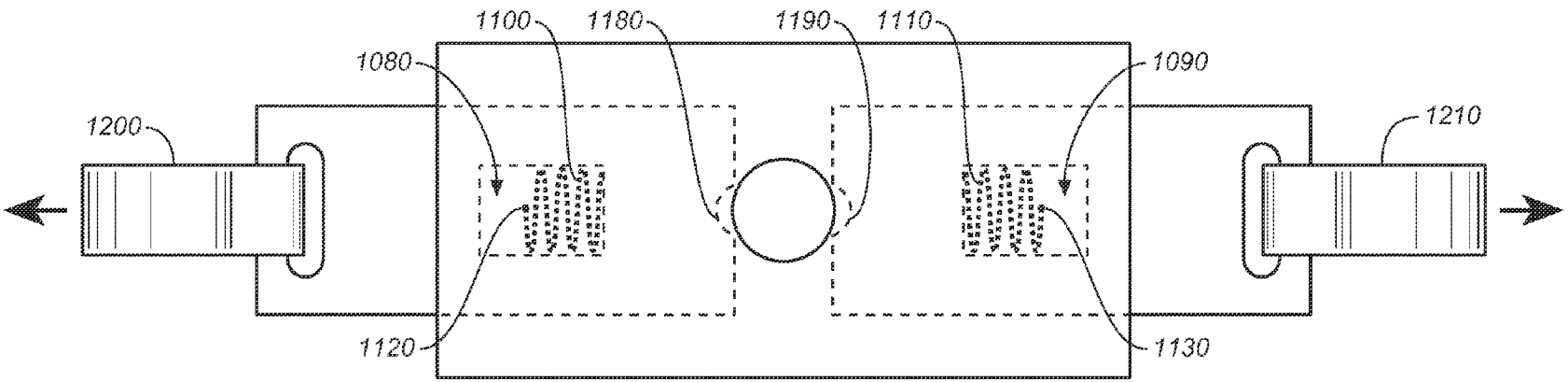

Referring next to FIGS. 15A-15B, there is shown the operation of each of the embodiments of FIGS. 12-13B and FIGS. 14A-14B.

Figure 16:
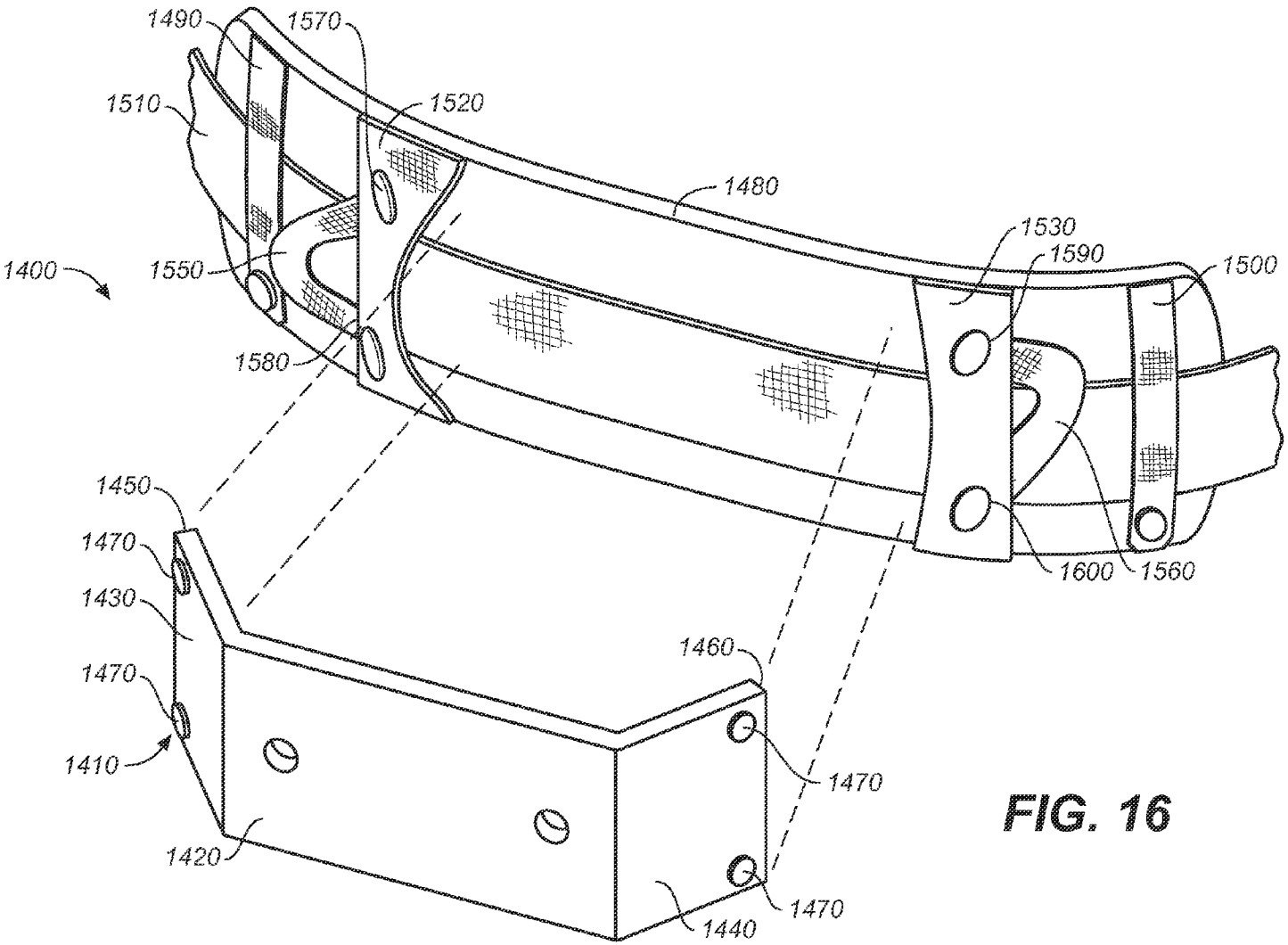
FIG. 16 is an upper front perspective view showing a fifth preferred embodiment of the quick release system of the present invention.
Figures 16A, 16B, 16C:
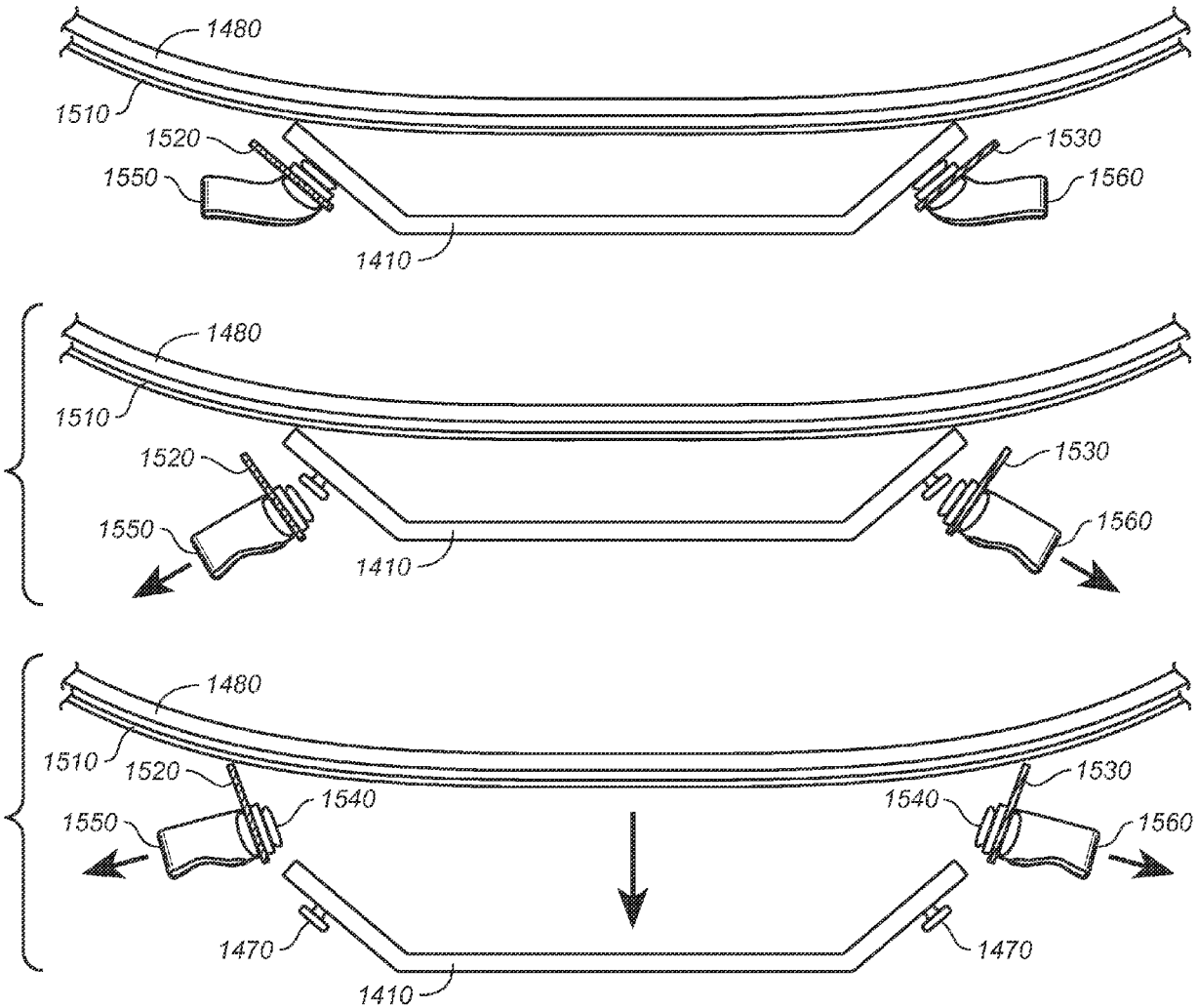
FIGS. 16A-16C are top plan views showing the operation of the system of FIG. 16 in coupling and decoupling a firefighters waist belt from an SCBA frame member.

Referring next to FIGS. 16-16C, there is shown a fifth preferred embodiment 1400 of the inventive quick release system. This embodiment mounts to the lumbar portion 1410 of a SCBA frame, which typically includes a generally planar or flat outer platform 1320 with angled wings 1430, 1440 at each side and which roughly conform to the wearer's back. To adapt the SCBA frame for this embodiment of the quick release system, the lateral ends 1450, 1460 of the angled wings are each provided with one or more male or female snap elements 1470.

The system next includes a fabric base pad 1480 with fabric loops 1490, 1500 for connecting the base pad to a waist belt 1510. The angled wings of the SCBA frame are slipped under and releasably captured by first and second fabric panels 1520, 1530 that also straddle the waist belt, but with sufficient clearance that the angled wings can slide underneath the fabric panels. Female or male snap elements 1540 are installed on the underside of the fabric panels so as to complement and engage with the snap elements to make a snap connection with the SCBA frame. Pull straps 1550, 1560 having ends 1570, 1580, 1590, 1600 terminating at the female snap caps provide the user with a pull handle to disengage the snaps and pull the fabric panels over the angled ends, thereby releasing the lumbar portion of the SCBA frame. Thus, yet another means is shown for quickly releasing an SCBA frame from the waist belt of the wearer while still allowing the wearer to keep in place the waist belt and any and all of its attached accoutrements on his or her person.

Figure 17A:
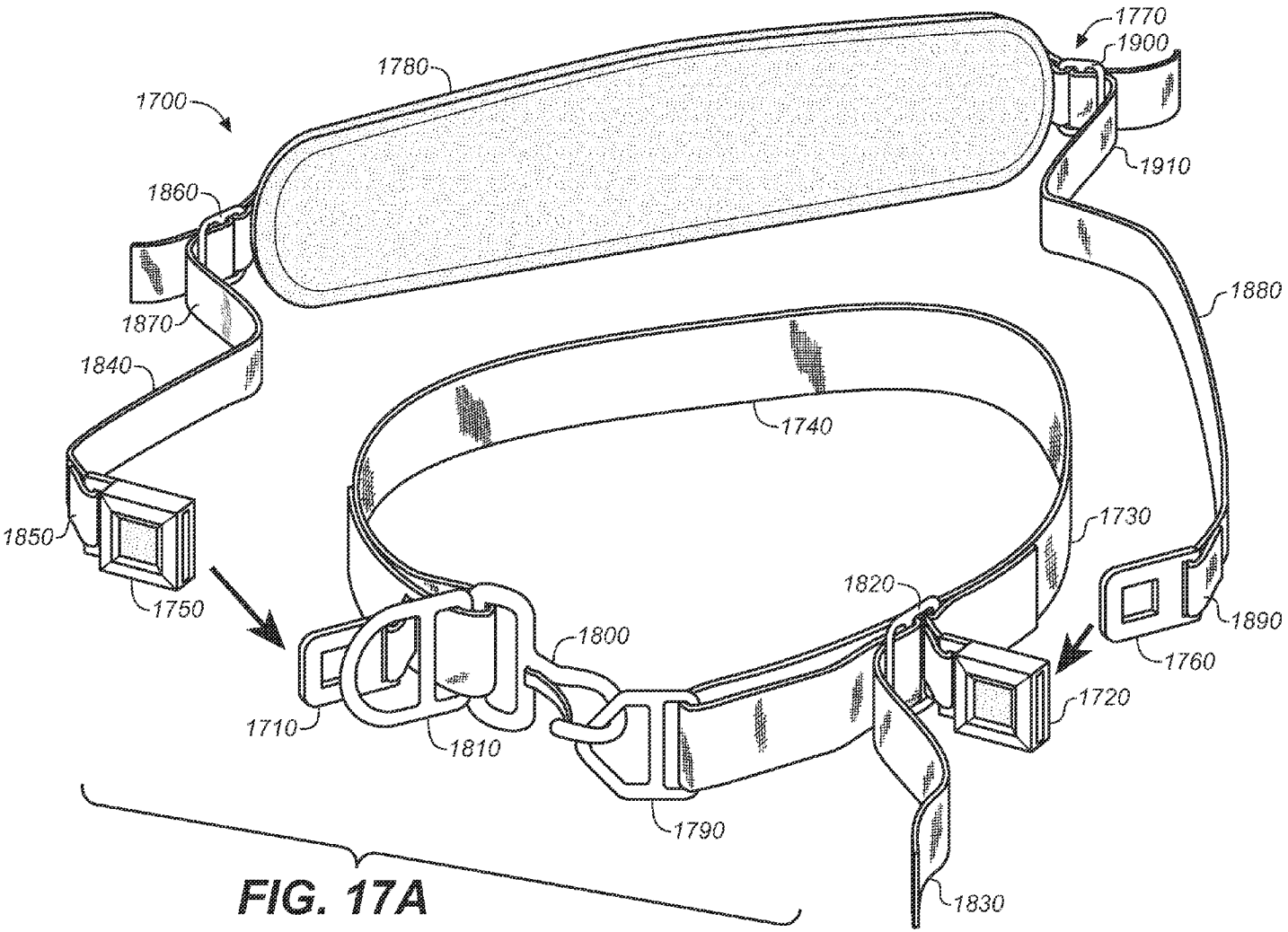
FIG. 17A is an upper perspective view showing a sixth preferred embodiment of the inventive quick release system in which an SCBA waist belt is detached from, but poised for connection to, quick release buckle members installed on a firefighter's equipment belt.
Figure 17B:
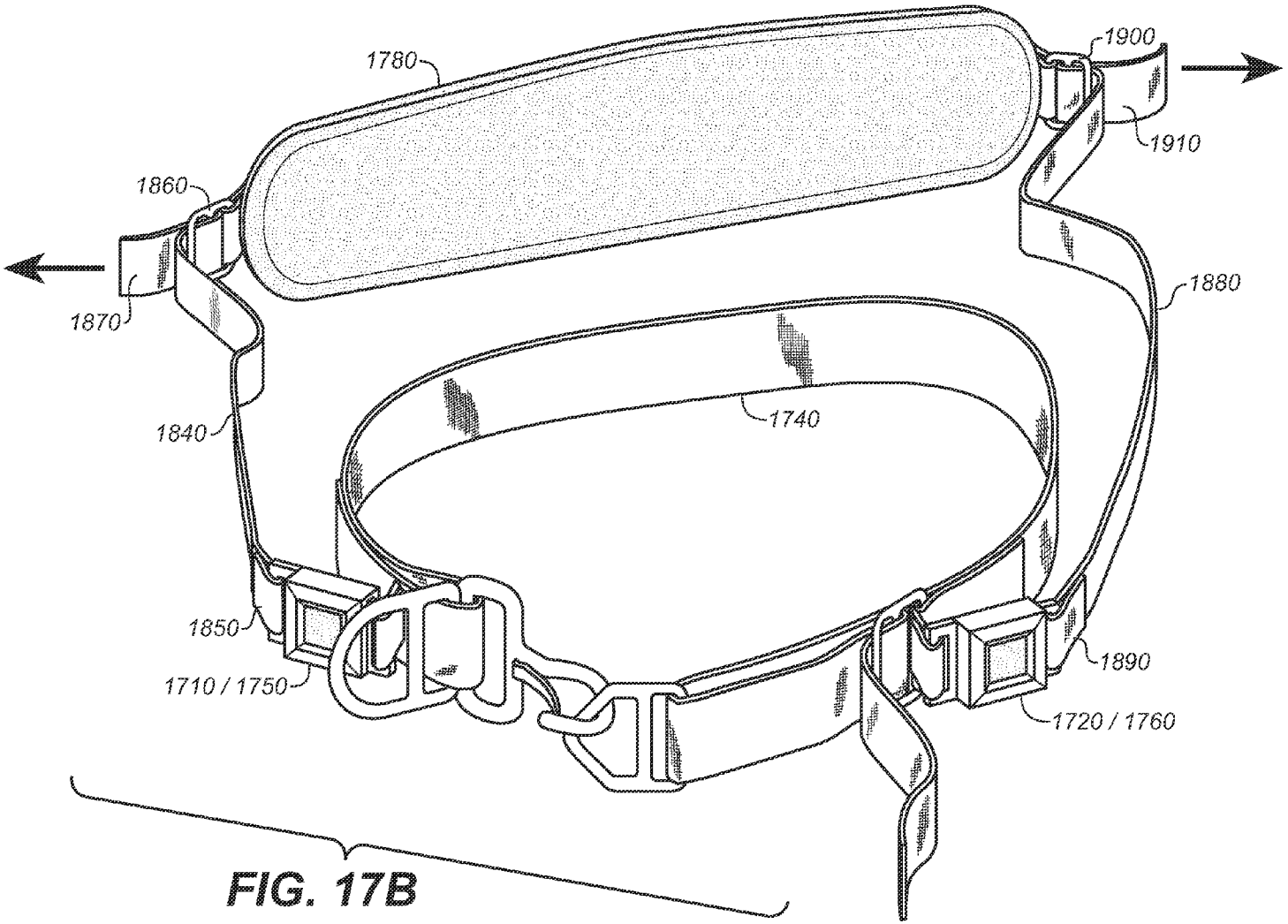
FIG. 17B shows the system of FIG. 17A with the SCBA belt coupled to the equipment belt.
Figure 17C:
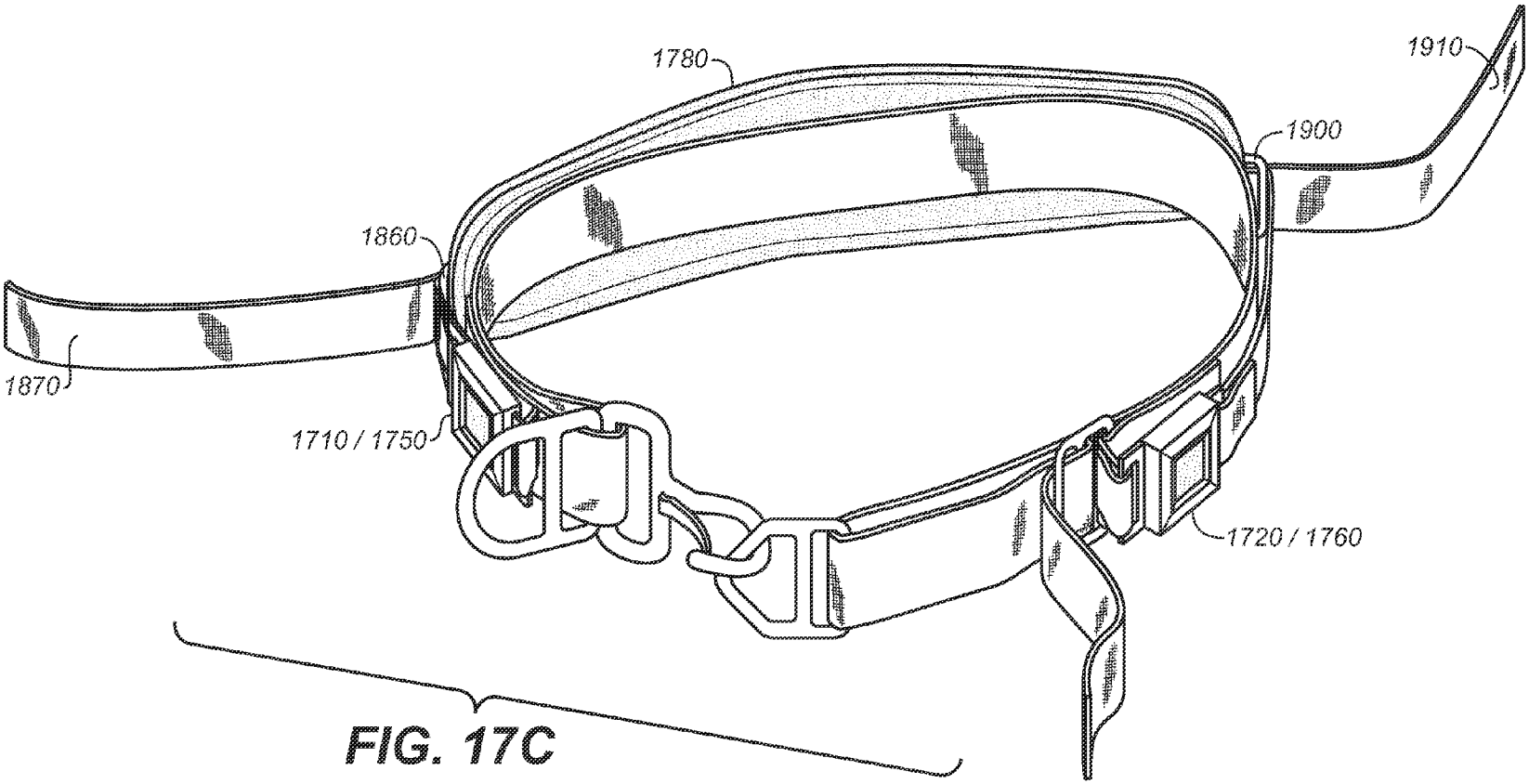
FIG. 17C shows the system of FIGS. 17A-17B with the SCBA waist belt adjusted and cinched to bring it into close contact with the firefighter's equipment belt.

Referring next to FIGS. 17A-C, there is shown a seventh preferred embodiment of the quick release system of the present invention. This embodiment addresses several practical concerns that call for an alternative to the foregoing novel designs. At present, when donning an SCBA, most firefighters have two waist belts circumscribing their midsection: one comprising their equipment belt; the other comprising the SCBA belt. This is inherently uncomfortable. The belts and the belt buckles are large and heavy and present a significant amount of mass and constraint immediately in front of the wearer's abdomen. Bending over can quite literally be painful. This is exacerbated by the fact that the belts are generally worn over turnout gear, which tends only to increase the mass in front of the wearer where the belts and buckles cause fabric bunching and binding. It would be desirable to eliminate the need for two waist belts when wearing an equipment belt and SCBA. As will be appreciated, the foregoing designs provide a solution to this problem.

However, firefighters typically already own authorized and certified SCBA apparatus, and even as firefighters increasingly adopt quick release systems for their SCBA's, either voluntarily or in compliance with department requirements, they are confronted with the need to modify their own SCBA's or to purchase entirely new and expensive equipment. Using one of the first through sixth embodiments described above requires the purchase of an SCBA certified for use with the quick release belt. And modification of the waist belt on an existing SCBA risks taking the system out of code compliance, and therefore renders it unfit for use.

To address these problems, the seventh preferred embodiment 1700 provides a simple and cost-effective solution. It will be readily appreciated that in this embodiment, the apparatus coupling apparatus comprises right and left tongue-eject buckle assemblies 1710, 1720, respectively, installed on the outside portion 1730 of the right and left strap portions of a rescue worker's (typically a firefighter's) waist belt 1740. The right and left buckle assemblies, 1710 and 1720, connect to the right and left waist buckles 1750, 1760, respectively of an SCBA waist belt 1770. For clarity in the illustrations, the SCBA itself is not shown in the views, but the lumbar portion 1780 of the frame or lumbar support pad is schematically shown to symbolize the SCBA itself and to indicate the structural relationships of the elements.

The firefighter's waist belt is shown here having a waist buckle comprising a ring 1790 and clip 1800, a D ring 1810, and an adjustment buckle 1820 with an adjustment strap 1830 fed through the adjustment buckle. The SCBA waist belt 1770 will typically include a right strap 1840 connected to a right buckle member 1750 at its distal end 1850 and to an adjustment buckle 1860 at its proximal end 1870, and a left strap 1880 having a complementary left buckle member 1760 connected to its distal end 1890, as well as an adjustment buckle 1900 at its proximal end 1910. The views show buckles on the firefighter's conforming to the type of buckle commonly used on SCBA waist belts, namely a tongue-eject type buckle of the kind found in contemporary motor vehicles. While this is a preferred buckle choice, the inventive system does not depend on the particular kind of buckle selected, though the buckle must be provided with features for a rapid release with minimal movement, and the prevention of false buckling and inadvertent unbuckling. Accordingly, the tongue-eject buckle assembly is currently a preferred design.

Positioned at the point generally proximate the wearer's iliac crest (the belt size being selected and adjusted to ensure such a configuration), the right and left tongue-eject buckles affixed to the firefighter's waist belt complement (male for female/female for male) the tongue-eject buckle members disposed on the distal ends of the right and left SCBA waist straps. Thus, rather than coupling the SCBA waist belt around the waist of the wearer, the wearer simply buckles the SCBA right and left buckle waist belt straps onto the firefighter's waist belt using the complementary buckle members (shown in FIG. 17B), and then uniformly shortens the SCBA right and left straps using the adjustment buckles (as seen in FIG. 17C) to keep the SCBA centered. Then, when a rapid release of the SCBA is called for, the push buttons on the female elements of the buckles are simply pushed and the SCBA waist belt is released.

In each of the above-described embodiments of the inventive quick release system, the user can selectively part with an SCBA in a confined space or when entangled. With respect to the first through sixth preferred embodiments, he or she does so merely by making a directed pull on the retention elements of the coupling apparatus—variously, pins in fabric loops, straps in a linear array of slots, pull bars engaging a male post, and pull straps operatively connected to snap elements. If unimpeded, the required pull (distance the elements must be translated) of any of the release and coupling elements is no more than a few inches and takes a fraction of a second to complete. With respect to the seventh preferred embodiment, he or she merely pushes the release buttons on the female portions of the connector buckle assembly. Disengagement and removal of the SCBA in its entirety is obviously not complete until the wearer can remove the remaining harness elements of the SCBA, but with the SCBA frame uncoupled from the waist belt, such an operation is made considerably easier.

It will be appreciated, therefore, that in its most essential aspect, each embodiment of the quick release system of the present invention includes a belt connection apparatus for connecting a firefighter's waist belt to an SCBA, either directly to the SCBA frame or to the SCBA waist belt. In several preferred embodiments, the coupling apparatus includes at least one, and preferably two, pullable rapid release member(s) that move in a first direction for connecting the belt connection apparatus to the SCBA frame connection apparatus and in a second direction (when pulled) for rapid disconnection of the belt connection apparatus from the SCBA frame connection apparatus. When the rapid release member(s) is/are pulled, the SCBA frame element is entirely disconnected from the waist belt, such that the wearer can effectively jettison or remove the SCBA from his or her body while leaving the waist belt and any attached accoutrements in place and on his or her person. In another preferred embodiment, the coupling apparatus includes tongue-eject buckle assemblies installed on the outside of a firefighter's waist belt for connecting the waist buckles of an SCBA waist belt to the firefighter's waist belt. Rather than coupling the SCBA waist belt around the waist of the wearer, the wearer buckles the SCBA waist belt onto the firefighter's waist belt. Then, when a rapid release of the SCBA is called for, the tongue-eject buttons are simply pushed and the SCBA waist belt is released.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A quick release apparatus for a rescue worker's waist belt for connecting to and rapidly disconnecting from a self-contained breathing apparatus waist belt, the rescue worker's waist belt including a right strap portion and a left strap portion, the self-contained breathing apparatus waist belt including a right waist strap portion having a right buckle member disposed at its end and a left strap waist strap portion having a left buckle member disposed at its end, said quick release apparatus comprising:

a right buckle member belt affixed to the right strap portion of the rescue worker's waist belt, said right buckle member being complementary to the self-contained breathing apparatus waist belt right buckle member;

a left buckle member belt affixed to the right strap portion of the rescue worker's waist belt, said left buckle member being complementary to the self-contained breathing apparatus waist belt left buckle member;

wherein connection of the rescue worker's waist belt and the self-contained breathing apparatus entails buckling the complementary right and left buckle members of the rescue worker's waist belt and the self-contained breathing apparatus, and rapid release of the self-contained breathing apparatus waist belt from the rescue worker's entails unbuckling the complementary right and left buckle members of the rescue worker's waist belt and the self-contained breathing apparatus, thereby allowing the wearer to entirely remove the self-contained breathing apparatus from his or her body while leaving the rescue worker's waist belt and any accoutrements attached thereto in place and on his or her person.

2. The apparatus of claim 1, wherein said right and left buckle members comprise male and female tongue-eject buckles members, respectively.

3. The apparatus of claim 1, wherein said right and left buckle members comprise female and male tongue-eject buckles members, respectively.

4. A method of connecting a rescue worker's waist belt to, and rapidly disconnecting the rescue worker's waist belt from, a self-contained breathing apparatus waist belt, comprising the steps of:

(a) providing a self-contained breathing apparatus having a waist belt that includes an adjustable right waist strap portion having a right buckle member disposed at its end and an adjustable left strap waist strap portion having a left buckle member disposed at its end;

(b) providing a rescue worker's waist belt including a right strap portion and a left strap portion, a right buckle member and a left buckle member, a waist buckle, an adjustment buckle for adjusting the length of the waist best, a right buckle member belt affixed to the right strap portion, the right buckle member being complementary to the self-contained breathing apparatus waist belt right buckle member, and a left buckle member belt affixed to the right strap portion of the rescue worker's waist belt, the left buckle member being complementary to the self-contained breathing apparatus waist belt left buckle member;

(c) buckling the complementary right and left buckle members of the rescue worker's waist belt and the self-contained breathing apparatus; and (d) unbuckling the complementary right and left buckle members of the rescue worker's waist belt and the self-contained breathing apparatus, thereby allowing the wearer to entirely remove the self-contained breathing apparatus from his or her body while leaving the rescue worker's waist belt and any accoutrements attached thereto in place and on his or her person.

5. The method of claim 4, including the further step of adjusting the adjustable right and left strap portions of the self-contained breathing apparatus so as to bring it into close contact with the rescue worker's waist belt.

* * * * *